US010222187B2

(12) United States Patent
Laska et al.

(10) Patent No.: US 10,222,187 B2
(45) Date of Patent: Mar. 5, 2019

(54) HUNTING PROJECTILE

(71) Applicant: Vista Outdoor Operations LLC, Farmington, UT (US)

(72) Inventors: David M. Laska, Andover, MN (US); Bryan P. Peterson, Isanti, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 15/646,832

(22) Filed: Jul. 11, 2017

(65) Prior Publication Data

US 2018/0010896 A1 Jan. 11, 2018

Related U.S. Application Data

(60) Provisional application No. 62/360,805, filed on Jul. 11, 2016.

(51) Int. Cl.

| | |
|---|---|
| ***F42B 5/02*** | (2006.01) |
| ***F42B 12/34*** | (2006.01) |
| ***F42B 33/00*** | (2006.01) |

(52) U.S. Cl.

CPC ..... *F42B 12/34* (2013.01); *F42B 5/02* (2013.01); *F42B 33/00* (2013.01); *F42B 33/001* (2013.01)

(58) Field of Classification Search

CPC ..... F42B 12/34

See application file for complete search history.

(56) References Cited

U.S. PATENT DOCUMENTS

| | | | |
|---|---|---|---|
| 1,080,974 | A | 12/1913 | Johnson |
| 1,135,357 | A | 4/1915 | Clyne |
| 1,328,334 | A | 1/1920 | Newton |
| 1,493,614 | A | 5/1924 | Dickerman |
| 1,967,416 | A | 7/1934 | Leussler |
| 3,881,421 | A | 5/1975 | Burczynski |
| 4,044,685 | A | 8/1977 | Avcin |
| 4,108,074 | A | 8/1978 | Billing, Jr. et al. |
| 4,245,557 | A | 1/1981 | Knappworst et al. |
| 4,655,140 | A | 4/1987 | Schirneker |
| 4,685,397 | A | 8/1987 | Schirneker |
| 5,127,332 | A | 7/1992 | Corzine et al. |
| 5,259,320 | A | 11/1993 | Brooks |
| 5,385,101 | A | 1/1995 | Corzine et al. |
| 5,454,325 | A | 10/1995 | LeBlanc |
| 6,070,532 | A | 6/2000 | Halverson |

(Continued)

FOREIGN PATENT DOCUMENTS

| | | | | |
|---|---|---|---|---|
| EP | 2551630 | A2 * | 1/2013 | ..... F42B 12/34 |
| GB | 190622505 | A | 5/1907 | |

(Continued)

*Primary Examiner* — Joshua T Semick

(74) *Attorney, Agent, or Firm* — Christensen, Fonder, Dardi & Herbert PLLC

(57) ABSTRACT

A projectile comprises a projectile body including a tail portion, a barrel engaging portion, a nose portion, a grooved portion, and a tip portion disposed along a central longitudinal axis of the projectile body. The tail portion has a rearward facing surface defining an plane. The tail portion extends forwardly along the central longitudinal axis of the projectile body between the rearward facing surface and the barrel engaging portion of the projectile body. The central longitudinal axis being orthogonal to the plane defined by the rearward facing surface.

20 Claims, 21 Drawing Sheets

(56) References Cited

U.S. PATENT DOCUMENTS

| | | | | |
|---|---|---|---|---|
| 6,317,946 | B1 | 11/2001 | Beal | |
| 6,526,893 | B2 | 3/2003 | May et al. | |
| 6,546,875 | B2 | 4/2003 | Vaughn et al. | |
| 7,380,502 | B2 | 6/2008 | Emary | |
| 7,814,837 | B2 * | 10/2010 | Sauvestre | F42B 12/34 102/508 |
| 8,186,277 | B1 * | 5/2012 | King | F42B 12/74 102/507 |
| 8,393,273 | B2 | 3/2013 | Weeks et al. | |

FOREIGN PATENT DOCUMENTS

| | | | | |
|---|---|---|---|---|
| RU | 2172922 | C1 * | 8/2001 | F42B 12/34 |
| RU | 2175106 | C1 * | 10/2001 | F42B 12/34 |
| WO | WO 01/18483 | | 3/2001 | |

* cited by examiner

HUNTING PROJECTILE

CROSS-REFERENCE TO RELATED APPLICATION

This application claims the benefit of U.S. Provisional Patent Application No. 62/360,805, filed Jul. 11, 2016, the disclosure of which is incorporated by reference herein.

BACKGROUND OF THE DISCLOSURE

In the sport of hunting, responsible hunters go to great lengths to ensure a quick, clean and humane kill. Hunters seek to select the best rifle, cartridge, bullet and optics for the particular species being hunted and the specific conditions likely to be encountered (e.g., rough terrain and thick underbrush). Hunters also practice marksmanship so that a shot can be carefully placed even under challenging circumstances. If a bullet is poorly placed, the game animal may travel a long distance through rough terrain after having been shot. In these situations, there is a risk that the wounded game animal will not be recovered.

In recent years, the modern sporting rifle (MSR) has become a popular firearm for use in hunting. The MSR is based on the AR-15 platform designed by Eugene Stoner while working as an engineer at the Armalite Company. The MSR may sometimes appear cosmetically similar to military rifles, such as the M-16. However, the MSR functions like other semi-automatic civilian sporting rifles, firing only one round with each pull of the trigger. The MSR is commercially available from several manufacturers. Each manufacturer may offer several MSR models in popular configurations.

Due environmental concerns, there have been efforts to replace lead in bullets with other materials. The relatively high deformability of lead allows lead bullets to expand on impact. Any improvements in the performance of non-lead bullets would be welcome.

SUMMARY

In some embodiments, a projectile comprises a projectile body including a tail portion, a barrel engaging portion, a nose portion, a grooved portion, and a tip portion. The tail portion has a rearward facing surface defining an XY plane. The tail portion extends forwardly along a central longitudinal axis of the projectile between the rearward facing surface and the barrel engaging portion of the projectile body. In some embodiments, the central longitudinal axis is orthogonal to the XY plane. The tail portion has a tail radius extending between the central longitudinal axis and an outer surface of the tail portion. In some embodiments, the tail radius increases as the tail portion extends forwardly along the central longitudinal axis.

The barrel engaging portion of the projectile body extends forwardly along the central longitudinal axis between the tail portion and the nose portion. The barrel engaging portion having a barrel engaging radius extending between the central longitudinal axis and an outer surface of the barrel engaging portion. In some embodiments, the barrel engaging radius remains substantially constant as the barrel engaging portion extends forwardly along the central longitudinal axis so that the barrel engaging portion has a shape generally corresponding to the shape of a cylinder.

The nose portion of the projectile body extends forwardly along the central longitudinal axis between the barrel engaging portion and the grooved portion. The nose portion has a nose radius extending between the central longitudinal axis and an outer surface of the nose portion. In some embodiments, the nose radius decreases as the nose portion extends forwardly along the central longitudinal axis so that the nose portion has a shape generally corresponding to the shape of an ogive. The nose portion has an interior surface and a nose wall extending between the interior and exterior surfaces thereof.

The grooved portion of the projectile body extending forwardly along the central longitudinal axis between the nose portion and the tip portion. The tip portion of the projectile body extending forwardly along the central longitudinal axis between the grooved portion and a forward facing edge of the tip portion. The forward facing edge defining an opening in the tip portion. The opening fluidly communicating with an interior cavity extending from the opening to a cavity end point within the nose portion. A forward portion of the interior cavity being defined by an interior surface of the tip portion. The interior surface of the tip portion being concave when viewed in a longitudinal cross-section of the projectile body. The tip portion having an exterior surface that is convex when viewed in a longitudinal cross-section of the projectile body. The tip portion having a tip wall extending between the interior and exterior surfaces thereof.

The grooved portion of the projectile body comprises first and second groove defining surfaces. The first and second groove-defining surfaces define an annular groove. The first groove defining surface meets the interior surface of the tip portion at a forward edge of the annular groove. The second groove defining surface meets an interior surface of the nose portion at a rearward edge of the annular groove. The first and second groove defining surfaces intersecting near an apex of the annular groove. The first and second groove defining surfaces defining an included angle of the annular groove. In some embodiments, the included angle has a magnitude of less than 90 degrees. The nose wall has a minimum thickness at the rearward edge of the annular groove and the tip wall has a maximum thickness at the forward edge of the annular groove. In some embodiments, the minimum thickness of the nose wall is greater than the maximum thickness of the tip wall.

In some embodiments, a centerfire rifle cartridge comprises a casing with a primer, propellant in the casing, and a hollow point bullet received in a lumen defined by the casing. The hollow point bullet may be homogeneous and may comprise copper. The bullet may have a forward end with a lip defining a mouth and an interior sidewall defining a cavity extending rearwardly from the lip. The interior sidewall may have a forward sidewall portion extending from the forward lip and converging to a neck portion of the sidewall and defining a first funnel portion. The interior sidewall at a mid-sidewall portion may be contiguous with and rearward of the neck portion. The mid-sidewall portion may diverge to an increased diameter portion as the interior sidewall extends rearward of the neck portion. The interior sidewall may converge from the increased diameter portion to a rearward-most terminus of the cavity as the interior sidewall extends rearward of the increased diameter portion. The forward sidewall portion at the first funnel portion may have a circumferential notch intermediate the mouth of the cavity and the neck portion.

A feature and advantage of embodiments is a projectile that addresses environmental concerns regarding lead by providing a projectile that is free of lead.

A feature and advantage of embodiments is a projectile that folds along one or more localized areas of weakness to assume a deformed shape.

A feature and advantage of embodiments is a projectile that forms an entrance wound when entering a body (such as the body of a game animal or a block of ballistic gel) and forms an exit wound that is larger than the entrance wound upon exiting the body. The relatively large exit wound may cause greater blood loss leading to a faster kill. The increased blood loss may also create a blood trail useful for tracking a wounded animal.

A feature and advantage of embodiments is a projectile that deforms to an expanded or mushroomed shape while passing through a body (such as the body of a game animal or a block of ballistic gel). In some embodiments, the expanded or mushroomed shape has an overall lateral width and a surface area that is greater than the overall lateral width and the surface area of the undeformed projectile.

A feature and advantage of embodiments is a projectile that forms multiple pedals while passing through a body (such as the body of a game animal or a block of ballistic gel). In some embodiments, the pedals provide enhanced cutting action. In some embodiments, the pedals increase the overall lateral width and the surface area of the projectile compared to the shape of the projectile before the multiple pedals are formed.

In some embodiments, the included angle defined by the first groove defining surface and the second groove defining surface is between 60 degrees and 90 degrees. In some embodiments, the included angle defined by the first groove defining surface and the second groove defining surface is between 65 degrees and 85 degrees. In some embodiments, the included angle defined by the first groove defining surface and the second groove defining surface is between 70 degrees and 80 degrees.

In some embodiments, the annular groove is generally V-shaped when viewed in a longitudinal cross-section of the projectile. In some embodiments, the thickness of the tip wall at the forward edge of the annular groove is between 0.010 inches and 0.038 inches. In some embodiments, the thickness of the tip wall at the forward edge of the annular groove is between 0.012 inches and 0.028 inches. In some embodiments, the thickness of the nose wall at the rearward edge of the annular groove is between 0.015 inches and 0.050 inches. In some embodiments, the thickness of the nose wall at the rearward edge of the annular groove is between 0.016 inches and 0.036 inches.

In some embodiments, the barrel engaging radius is between 0.07 inches and 0.25 inches. In some embodiments, the barrel engaging radius is between 0.08 inches and 0.18 inches. In some embodiments, the projectile body is integrally formed from a unitary piece of metal. In some embodiments, the projectile body comprises a metal. In some embodiments, the projectile body comprises copper. In some embodiments, the projectile has a weight between 30 grains and 300 grains. In some embodiments, the projectile has a weight between 50 grains and 200 grains.

In some embodiments, a method of forming a projectile comprises arranging for a coil of metal wire to be shipped from a first geographic location to a second geographic location. In some embodiments, the metal wire has a standard wire gauge such as a wire gauge listed in the American Wire Gauge (AWG) system. In some embodiments, the first geographic location and the second geographic location are separated by a distance of more than 500 miles. The method may further include feeding a length of the metal wire through a plurality of rollers R to straighten the metal wire. The metal wire is cut to form a billet having a billet length BL and a billet diameter BD. The billet is place in a lumen defined by a first die. In some embodiments, the lumen has a lumen diameter LD that is greater than the billet diameter BD and a lumen length LL that is greater than the billet length BL. A pin is positioned in the lumen defined by a first die on a first side of the billet and a tool is positioned in the lumen defined by the first die on a second side of the billet so that the billet is disposed between the pin and the tool. One of the tool and the pin is moved toward the other of the tool and the pin so that the billet is squeezed between the tool and the pin thereby forming a workpiece by deforming the billet.

In some embodiments, the workpiece has workpiece diameter WD that is greater than the billet diameter BD and a workpiece length WL that is smaller than the billet length BL. In some embodiments, the workpiece has a shoulder surface and a forward lip extending forwardly beyond the shoulder surface. The forward lip has a lip surface. The lip surface of the forward lip and the shoulder surface meet at a corner. The lip surface of the forward lip and the shoulder surface define a first included angle FA. In some embodiments, the first included angle FA has a magnitude greater than 90 degrees.

The method may also include placing the workpiece in a die cavity defined by a second die. In some embodiments, the die cavity has a tapered surface and the tapered surface has a taper radius that decreases as the tapered surface extends in a forward direction F. An end of a drive pin is inserted into the die cavity. The drive pin may be used to push the workpiece against the tapered surface so that a forward portion of the workpiece is deformed. After deformation, the lip surface of the forward lip and the shoulder surface define an annular groove. In some embodiments, the annular groove has a second included angle SA that is smaller than the first included angle FA.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
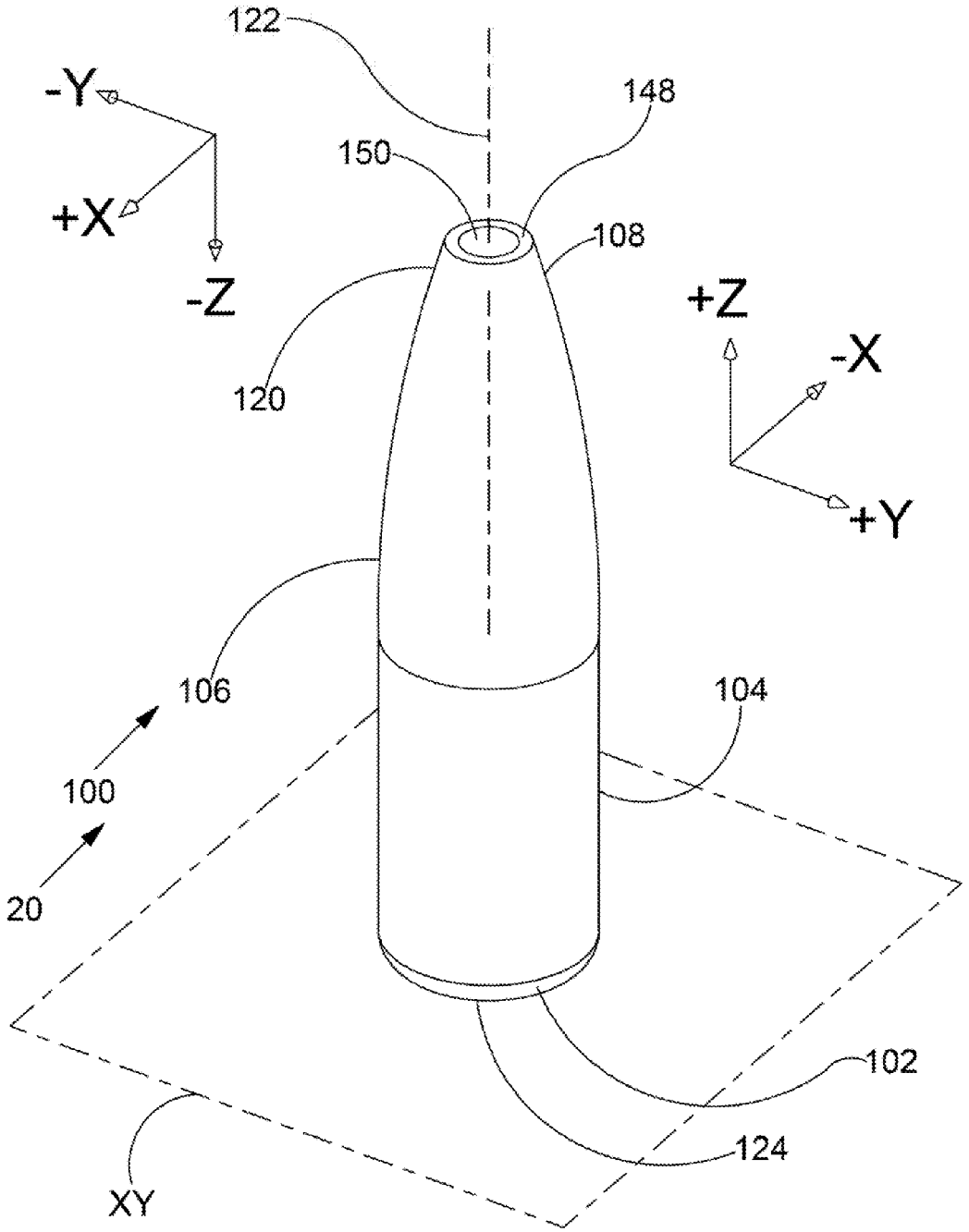
FIG. 1 is a perspective view showing a projectile in accordance with the detailed description.
Figure 2:
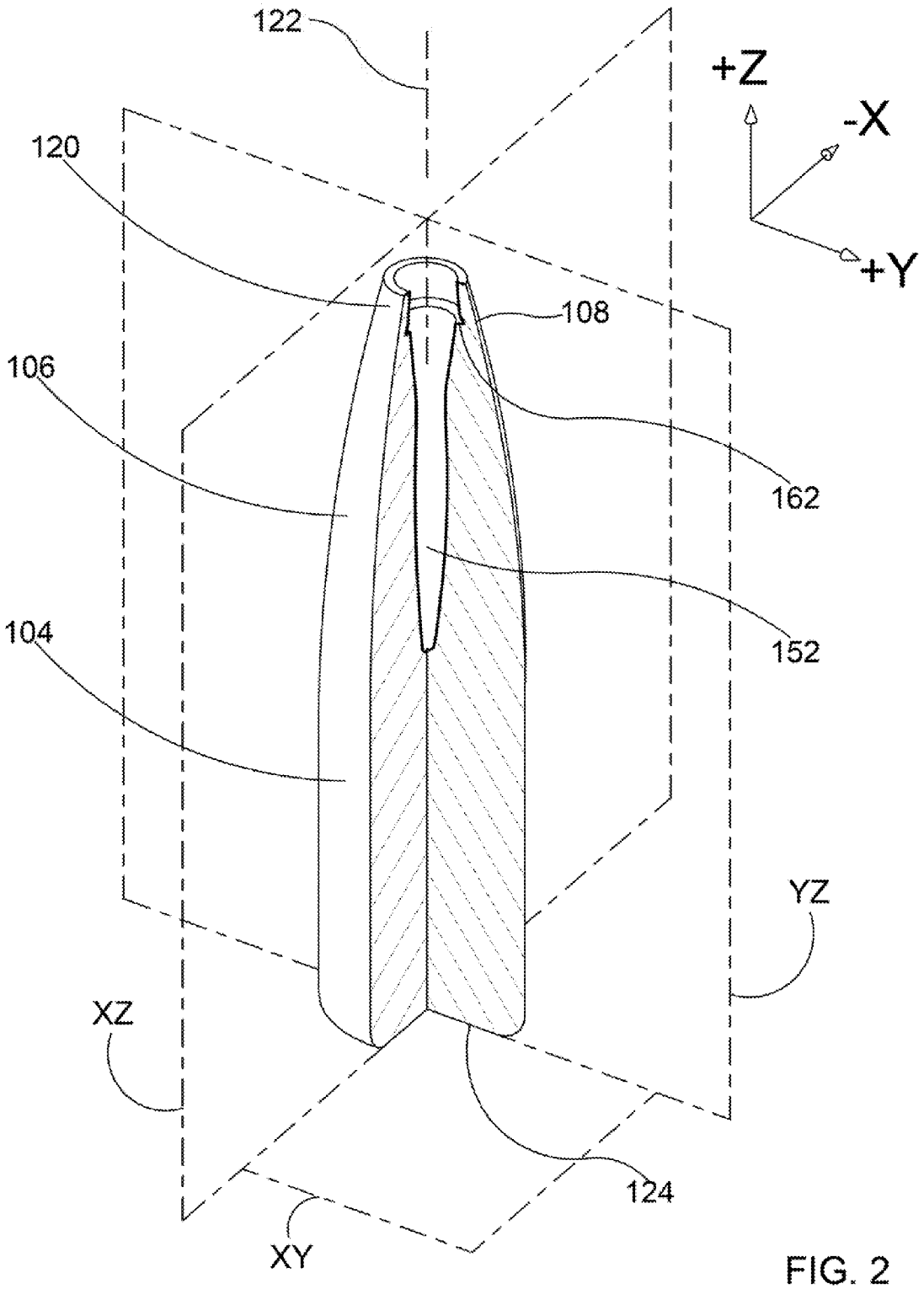
FIG. 2 is a perspective view of a projectile in accordance with the detailed description. In the embodiment of FIG. 2, the projectile has been sectioned along a plane YZ and a plane XZ.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1, a projectile 20 comprises a projectile body 100 including a tail portion 102, a barrel engaging portion 104, a nose portion 106, a grooved portion 108, and a tip portion 120 disposed along a central longitudinal axis 122 of the projectile body 100. The tail portion 102 has a rearward facing surface 124 defining an XY plane. The tail portion 102 extending forwardly along the central longitudinal axis 122 of the projectile body 100 between the rearward facing surface 124 and the barrel engaging portion 104 of the projectile body. The central longitudinal axis 122 being orthogonal to the XY plane defined by the rearward facing surface 124.

Referring to FIGS. 1-8 and 19-21, a projectile 20 comprises a projectile body 100 including a tail portion 102, a barrel engaging portion 104, a nose portion 106, a grooved portion 108, and a tip portion 120 disposed along a central longitudinal axis 122 of the projectile body 100. The tail portion 102 has a rearward facing surface 124 defining an XY plane. The tail portion 102 extending forwardly along the central longitudinal axis 122 of the projectile body 100 between the rearward facing surface 124 and the barrel engaging portion 104 of the projectile body. The central longitudinal axis 122 being orthogonal to the XY plane defined by the rearward facing surface 124. The tail portion having a tail radius 126 extending between the central longitudinal axis 122 and an outer surface 130T of the tail portion 102. The tail radius 126 increasing as the tail portion 102 extends forwardly along the central longitudinal axis 122.

The barrel engaging portion 104 of the projectile body 100 extends forwardly along the central longitudinal axis 122 between the tail portion 102 and the nose portion 106. The barrel engaging portion 104 has a barrel engaging radius 140 extending between the central longitudinal axis 122 and an outer surface 130B of the barrel engaging portion 104. In the example embodiment shown in the figures, the barrel engaging radius 140 remains substantially constant as the barrel engaging portion 104 extends forwardly along the central longitudinal axis 122 so that the barrel engaging portion 104 has a shape generally corresponding to the shape of a cylinder.

The nose portion 106 of the projectile body 100 extends forwardly along the central longitudinal axis 122 between the barrel engaging portion 104 and the grooved portion 108. The nose portion 106 has a nose radius 142 extending between the central longitudinal axis 122 and an outer surface 130N of the nose portion 106. In the example embodiment shown in the figures, the nose radius 142 decreases as the nose portion 106 extends forwardly along the central longitudinal axis 122 so that the nose portion 106 has a shape generally corresponding to the shape of an ogive. The nose portion 106 has an interior surface 144N and a nose wall 146 extending between the interior surface 144N and the exterior surface 130N.

The grooved portion 108 of the projectile body 100 extends forwardly along the central longitudinal axis 122 between the nose portion 106 and the tip portion 120. The tip portion 120 of the projectile body 100 extends forwardly along the central longitudinal axis 122 between the grooved portion 108 and a forward facing edge 148 of the tip portion 120. The forward facing edge 148 defines an opening 150 in the tip portion 120. The opening 150 fluidly communicates with an interior cavity 152 extending from the opening 150 to a rearward-most cavity end point 154 within the nose portion 106. A forward portion of the interior cavity 152 is defined by an interior surface 144T of the tip portion 120. The interior surface 144T of the tip portion 120 is concave when viewed in a longitudinal cross-section of the projectile body 100. The tip portion 120 has an outer surface 130T that is convex when viewed in a longitudinal cross-section of the projectile body. The tip portion 120 includes a tip wall 156 extending between the interior surface 144T and the outer surface 130T.

In some embodiments, the interior cavity 152 extends rearward along the central longitudinal axis from the opening 150 to a rearward-most cavity end point 154 within the nose portion 106. In some embodiments, the projectile body has an overall length extending along the central longitudinal axis between the forward facing edge 148 of the tip portion 120 and the rearward facing surface 124 of the tail portion 102. In some embodiments, the interior cavity 152 extends rearward from the opening 150 along the central longitudinal axis by a distance more than 35% of an overall length of the projectile body. In some embodiments, the interior cavity 152 extends rearward from the opening 150 along the central longitudinal axis by a distance more than 45% of an overall length of the projectile body. In some embodiments, the interior cavity 152 extends rearward from the opening 150 along the central longitudinal axis by a distance that is about 50% of an overall length of the projectile body.

The tail portion extends forwardly along the central longitudinal axis of the projectile body between the rearward facing surface and the barrel engaging portion of the projectile body.

The grooved portion 108 of the projectile body 100 comprising a first groove defining surface 158 and a second groove defining surface 160. The first groove defining surface 158 and the second groove defining surface 160 define an annular groove 162. The first groove defining surface 158 meets the interior surface 144T of the tip portion 120 at a forward edge 164 of the annular groove 162. The second groove defining surface 160 meets an interior surface 144N of the nose portion 106 at a rearward edge 166 of the annular groove 162. The first groove defining surface 158 and the second groove defining surface 160 intersect near an apex 168 of the annular groove 162. The first groove defining surface 158 and the second groove defining surface 160 define an included angle A of the annular groove 162. In some embodiments, the included angle A has a magnitude of less than 90 degrees.

The nose wall 146 has a minimum thickness TN at the rearward edge 166 of the annular groove 162. The tip wall 156 has a maximum thickness TT at the forward edge 164 of the annular groove 162. In some embodiments, the minimum thickness TN of the nose wall 146 is greater than the maximum thickness TT of the tip wall 156. In some embodiments, the annular groove 162 has a depth extending laterally outward from the rearward edge 166 of the annular groove 162 that is greater than 25% of the minimum thickness TN of the nose wall 146. In some embodiments, the annular groove 162 has a depth extending laterally outward from the rearward edge 166 of the annular groove 162 that is greater than 33% of the minimum thickness TN of the nose wall 146. In some embodiments, the annular groove 162 has a depth extending laterally outward from the forward edge 164 of the annular groove 162 that is greater than 20% of the maximum thickness TT of the tip wall 156. In some embodiments, the annular groove 162 has a depth extending laterally outward from the forward edge 164 of the annular groove 162 that is greater than 33% of the maximum thickness TT of the tip wall 156.

In some embodiments, the included angle defined by the first groove defining surface 158 and the second groove defining surface 160 is between 60 degrees and 90 degrees. In some embodiments, the included angle defined by the first groove defining surface 158 and the second groove defining surface 160 is between 65 degrees and 85 degrees. In some embodiments, the included angle defined by the first groove defining surface 158 and the second groove defining surface 160 is between 70 degrees and 80 degrees.

In some embodiments, the annular groove is generally V-shaped when viewed in a longitudinal cross-section of the projectile. In some embodiments, the thickness of the tip wall at the forward edge of the annular groove is between 0.010 inches and 0.038 inches. In some embodiments, the thickness of the tip wall at the forward edge of the annular groove is between 0.012 inches and 0.028 inches. In some embodiments, the thickness of the nose wall at the rearward edge of the annular groove is between 0.015 inches and 0.050 inches. In some embodiments, the thickness of the nose wall at the rearward edge of the annular groove is between 0.016 inches and 0.036 inches.

In some embodiments, the barrel engaging radius is between 0.07 inches and 0.25 inches. In some embodiments, the barrel engaging radius is between 0.08 inches and 0.18 inches. In some embodiments, the projectile body is integrally formed from a unitary piece of metal. In some embodiments, the projectile body comprises a metal. In some embodiments, the projectile body comprises copper. In some embodiments, the projectile has a weight between 30 grains and 300 grains. In some embodiments, the projectile has a weight between 50 grains and 200 grains.

Referring to FIGS. 9-16, a method of forming a projectile comprises arranging for a coil C of metal wire 170 to be shipped from a first geographic location to a second geographic location. In some embodiments, the metal wire 170 has a standard wire gauge such as a wire gauge listed in the American Wire Gauge (AWG) system. In some embodiments, the first geographic location and the second geographic location are separated by a distance of more than 500 miles. The method may further include feeding a length of the metal wire 170 through a plurality of rollers R to straighten the metal wire 170. The metal wire is cut to form a billet 172 having a billet length BL and a billet diameter BD. The billet 172 is place in a lumen 174 defined by a first die 176. In some embodiments, the lumen 174 has a lumen diameter LD that is greater than the billet diameter BD and a lumen length LL that is greater than the billet length BL. A pin 198 is positioned in the lumen 174 defined by a first die 176 on a first side of the billet 172 and a tool 123 is positioned in the lumen 174 defined by the first die 176 on a second side of the billet 172 so that the billet 172 is disposed between the pin 198 and the tool 123. One of the tool 123 and the pin 198 is moved toward the other of the tool 123 and the pin 198 so that the billet 172 is squeezed between the tool 123 and the pin 198 thereby forming a workpiece 178 by deforming the billet 172.

In some embodiments, the workpiece has workpiece diameter WD that is greater than the billet diameter BD and a workpiece length WL that is smaller than the billet length BL. In some embodiments, the workpiece 178 has a shoulder surface 180 and a forward lip 182 extending forwardly beyond the shoulder surface 180. The forward lip 182 has a lip surface 184. The lip surface 184 of the forward lip 182 and the shoulder surface 180 meet at a corner 186. The lip surface 184 of the forward lip 182 and the shoulder surface 180 define a first included angle FA. In some embodiments, the first included angle FA has a magnitude greater than 90 degrees.

The method may also include placing the workpiece 178 in a die cavity 190 defined by a second die 192. In some embodiments, the die cavity 190 has a tapered surface 194 and the tapered surface 194 has a taper radius that decreases as the tapered surface extends in a forward direction F. An end of a drive pin 196 is inserted into the die cavity 190. The drive pin 196 may be used to push the workpiece 178 against the tapered surface 194 so that a forward portion of the workpiece 178 is deformed. After deformation, the lip surface 184 of the forward lip 182 and the shoulder surface 180 define an annular groove. In some embodiments, the annular groove has a second included angle SA that is smaller than the first included angle FA.

Figure 17:
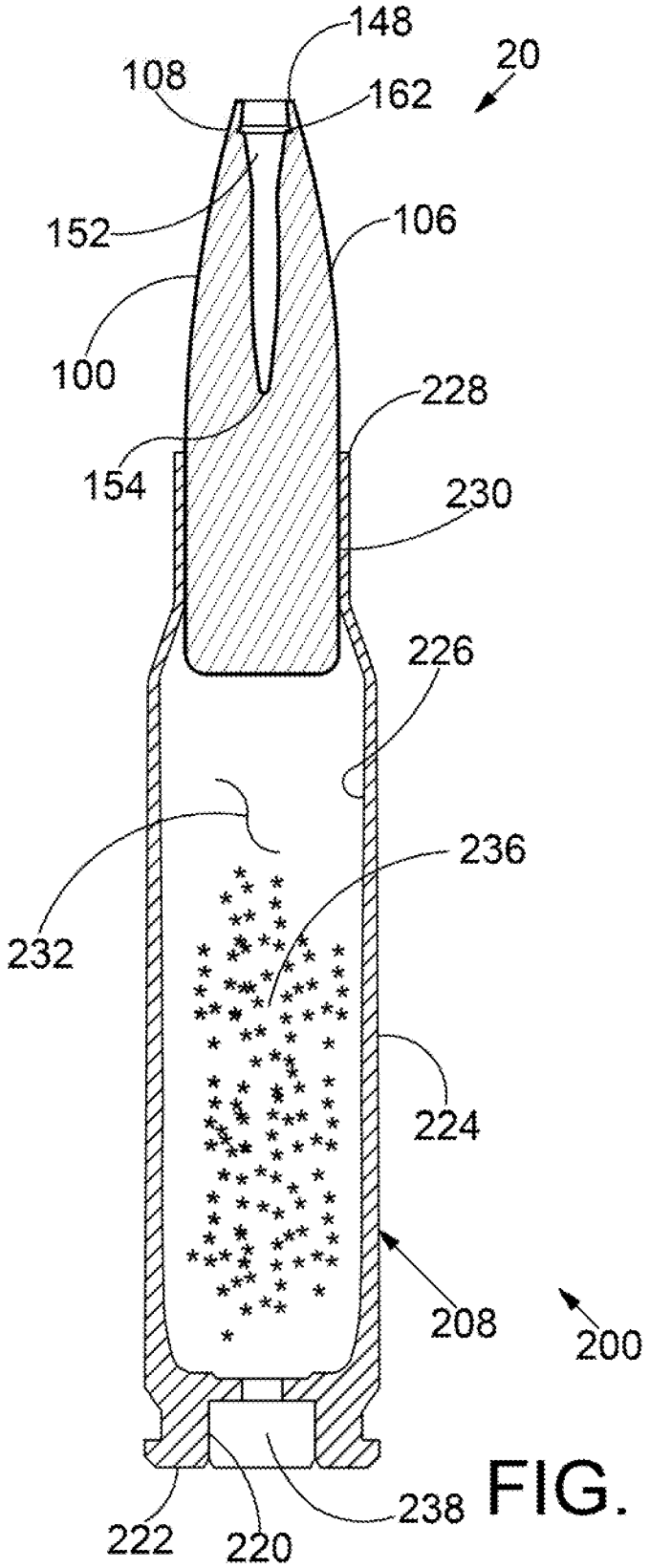
FIG. 17 is a cross-sectional view of a centerfire rifle cartridge.

Referring to FIG. 17, a centerfire rifle cartridge 200 in accordance with one or more embodiments comprises a casing 208 comprising a base portion 222 and a casing wall 224 extending forward from the base portion 222 to a forward edge 228 of the casing wall 224. An inner surface 226 of the casing wall 224 defines a lumen 230, the lumen 230 extending rearward from the forward edge 228 toward the base portion 222. In an embodiment, the base portion 222 and the inner surface 226 of the casing wall 224 define a cavity 232 and the cavity 232 fluidly communicates with the lumen 230. In an embodiment, a propellant 236 is disposed inside the cavity 232 for producing a quantity of propellant gas and a primer 238 is disposed in a hole 220 defined by the base portion 222 of the casing 208. The primer 238 comprises a primer housing and a priming material disposed inside the primer housing for igniting the propellant 236. The cartridge 200 also comprises a bullet 20 comprising a bullet body 100. The bullet body 100 of the bullet 20 is received in the lumen 230 defined by the casing wall 224 of the casing 208.

Figure 18:
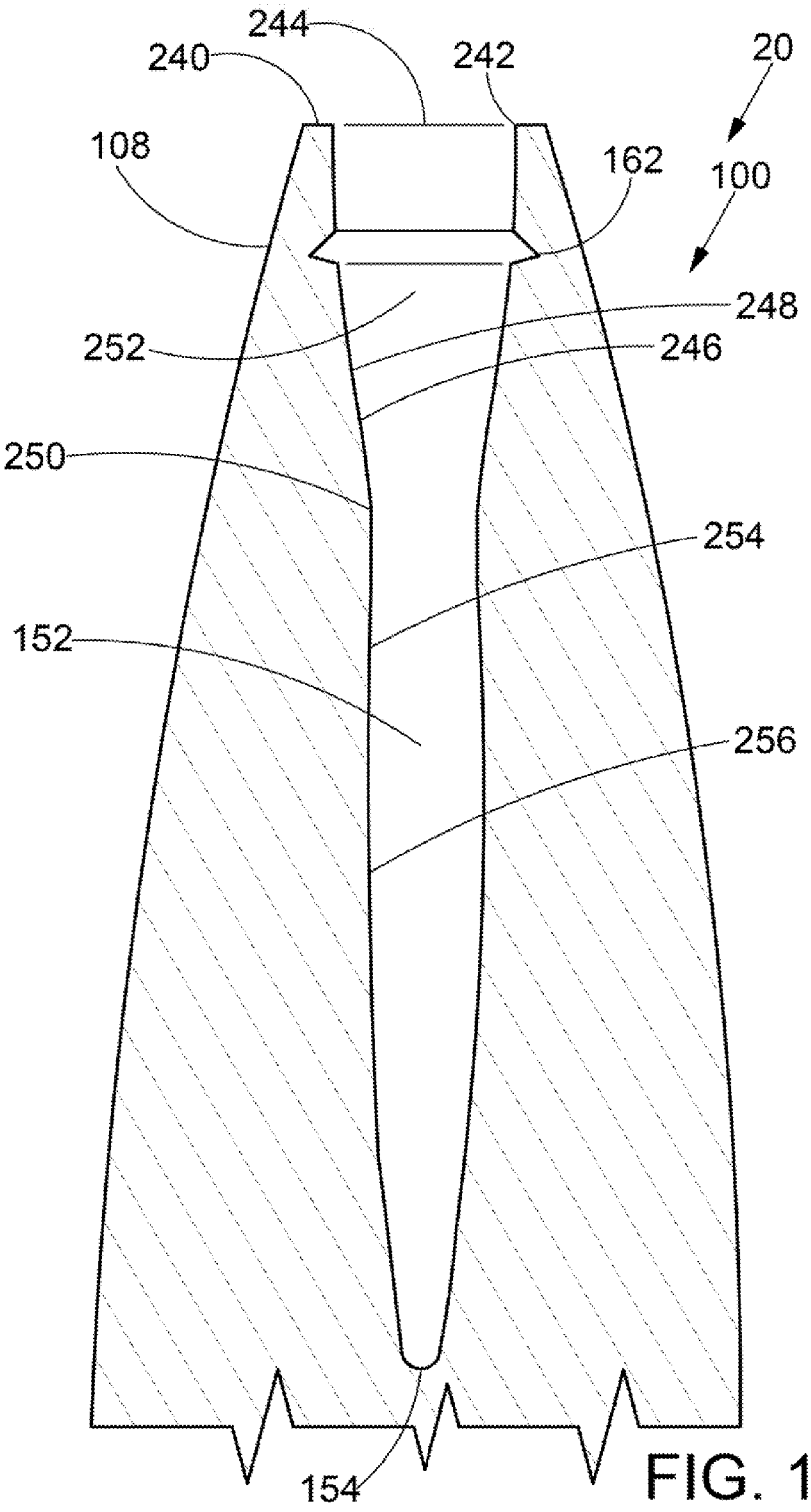
FIG. 18 is an enlarged cross-sectional view showing a portion of the projectile shown in FIGS. 1-4 and FIG. 17.
Figure 19:
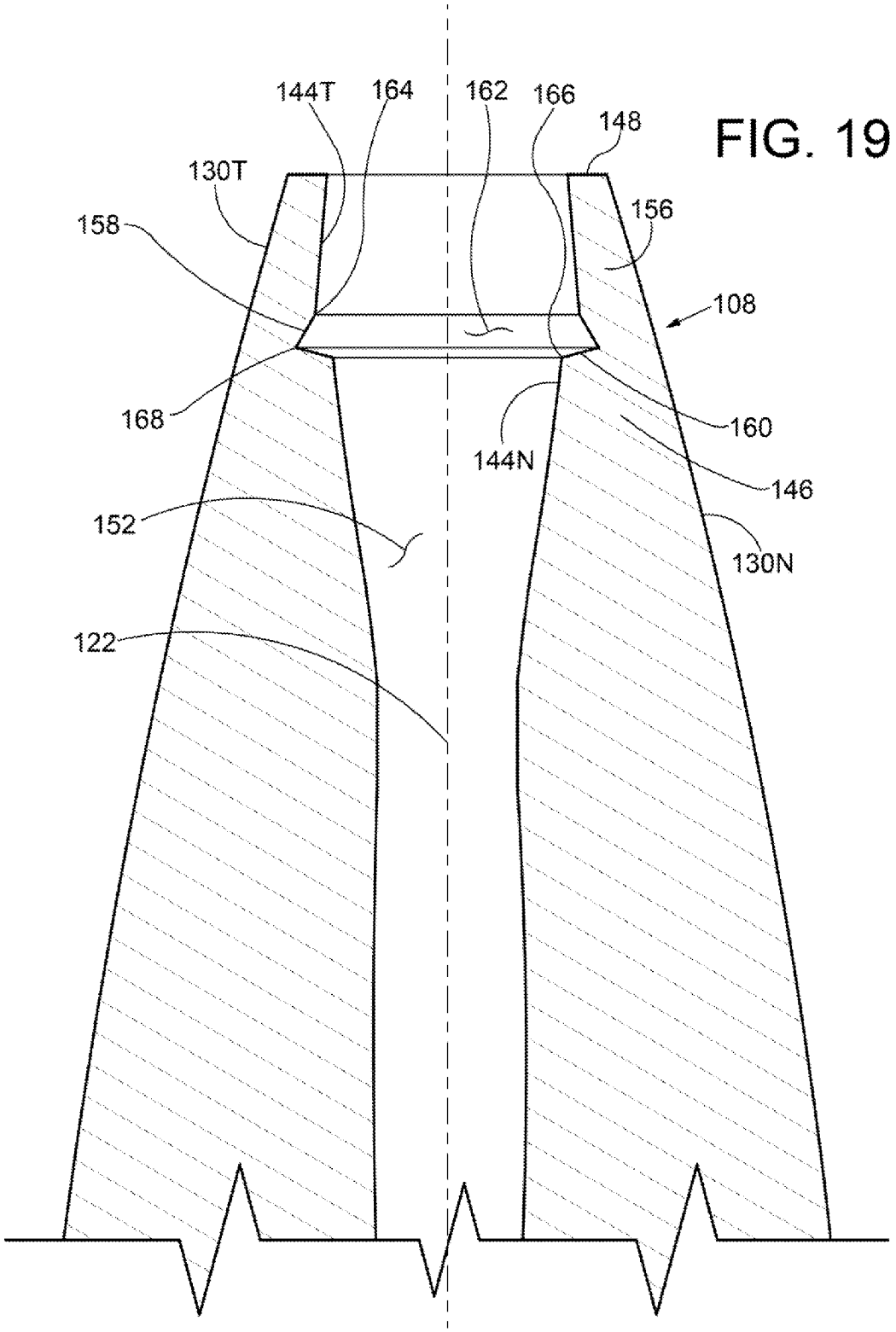
FIG. 19 is a cross-sectional view showing a portion of a projectile.
Figure 20:
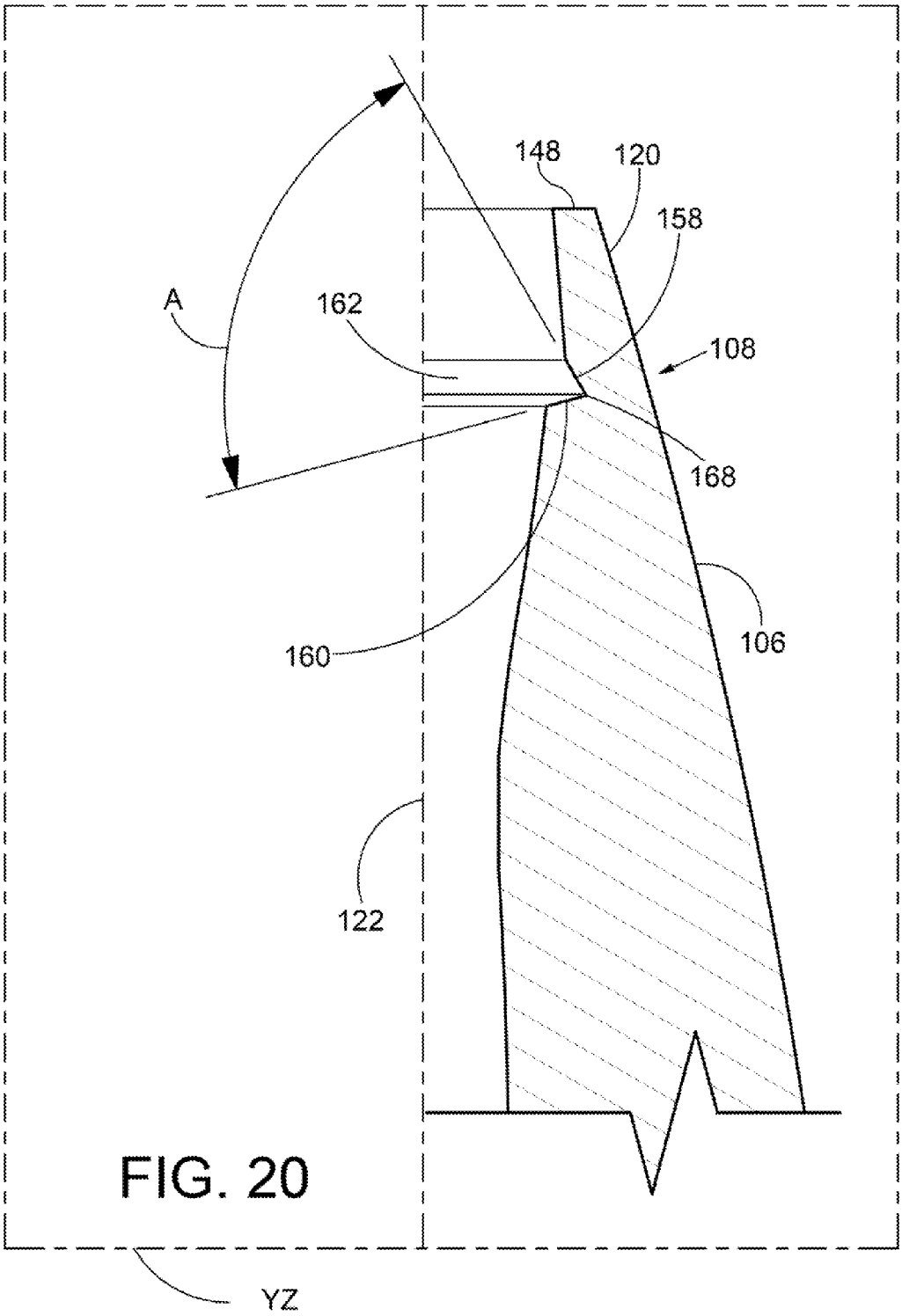
FIG. 20 is a partial cross-sectional view showing a portion of the projectile shown in FIG. 19.
Figure 21:
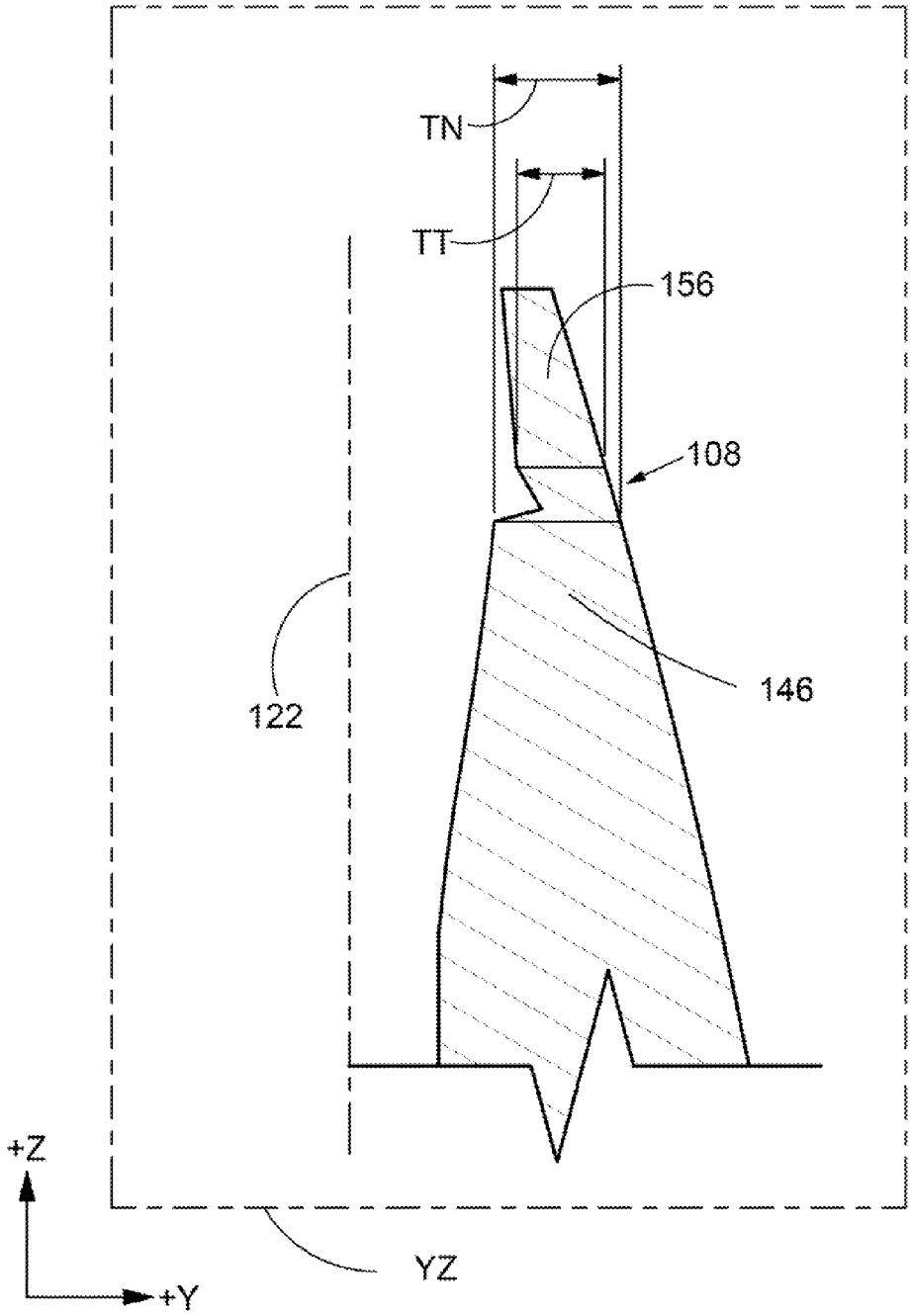
FIG. 21 is a partial cross-sectional view showing a portion of the projectile shown in FIG. 20.

Referring to FIGS. 17 and 18, a centerfire rifle cartridge 200 comprises a casing 208 with a primer 238, propellant 236 in the casing 208, and a hollow point bullet 20 received in a lumen 230 defined by the casing 208. The hollow point bullet 20 may be homogeneous and may comprise copper. The bullet 20 may have a forward end 240 with a lip 242 defining a mouth 244 and an interior sidewall 246 defining a cavity 152 extending rearwardly from the lip 242. The interior sidewall 246 may have a forward sidewall portion 248 extending rearward from the forward lip 242 and converging to a neck portion 250 of the interior sidewall 246 and defining a first funnel portion 252. The interior sidewall 246 at a mid-sidewall portion 254 may be contiguous with and rearward of the neck portion 250. The mid-sidewall portion 254 may diverge to an increased diameter portion 256 as the interior sidewall 246 extends rearward of the neck portion 250. The interior sidewall 246 may converge from the increased diameter portion 256 to a rearward-most terminus 154 of the cavity 152 as the interior sidewall 246 extends rearward of the increased diameter portion 256. The forward sidewall portion 248 at the first funnel portion 252 may have a circumferential notch 162 intermediate the mouth 244 of the cavity 152 and the neck portion 250.

Figure 3:
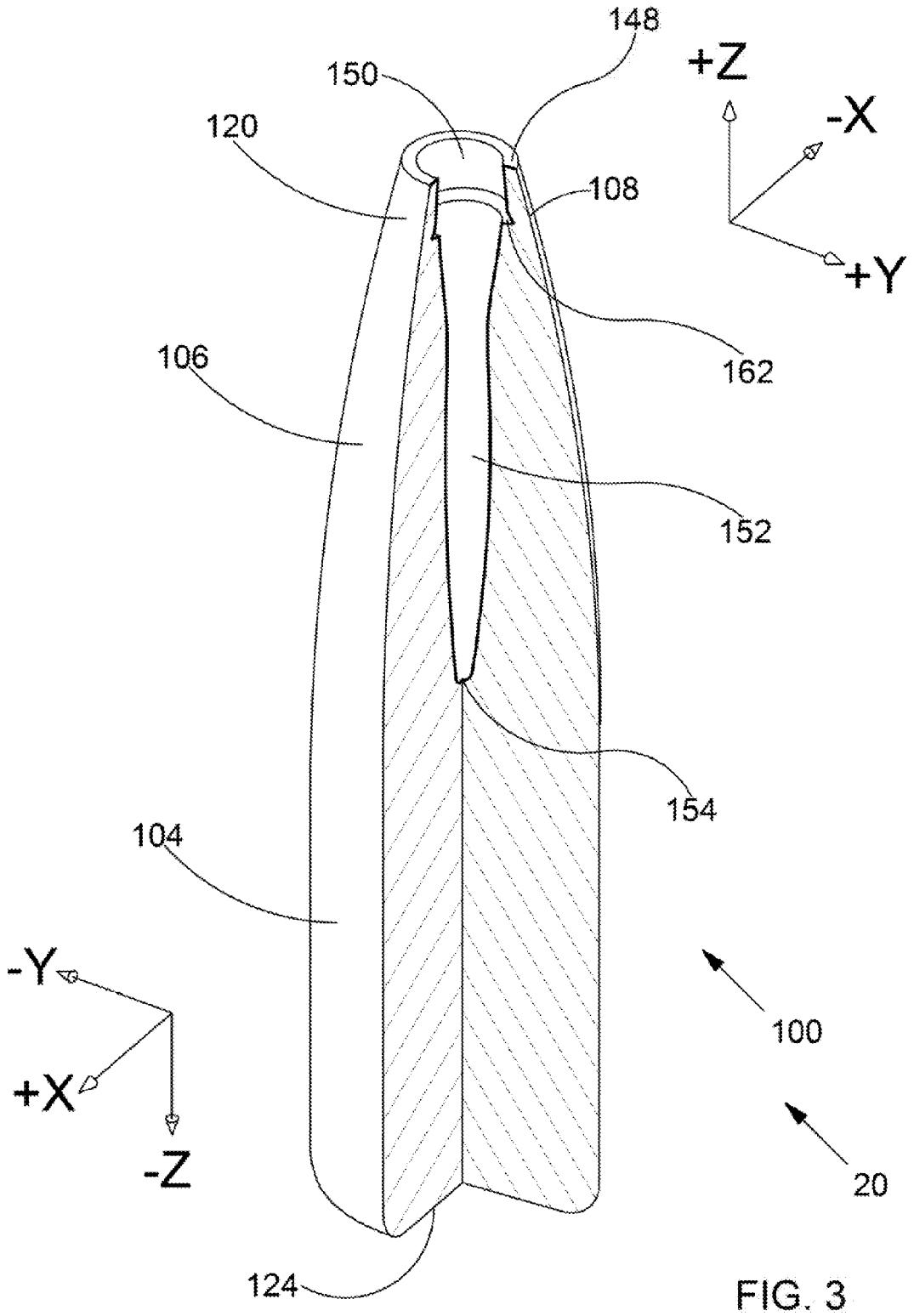
FIG. 3 is an enlarged perspective view of the projectile shown in FIG. 2.
Figure 4:
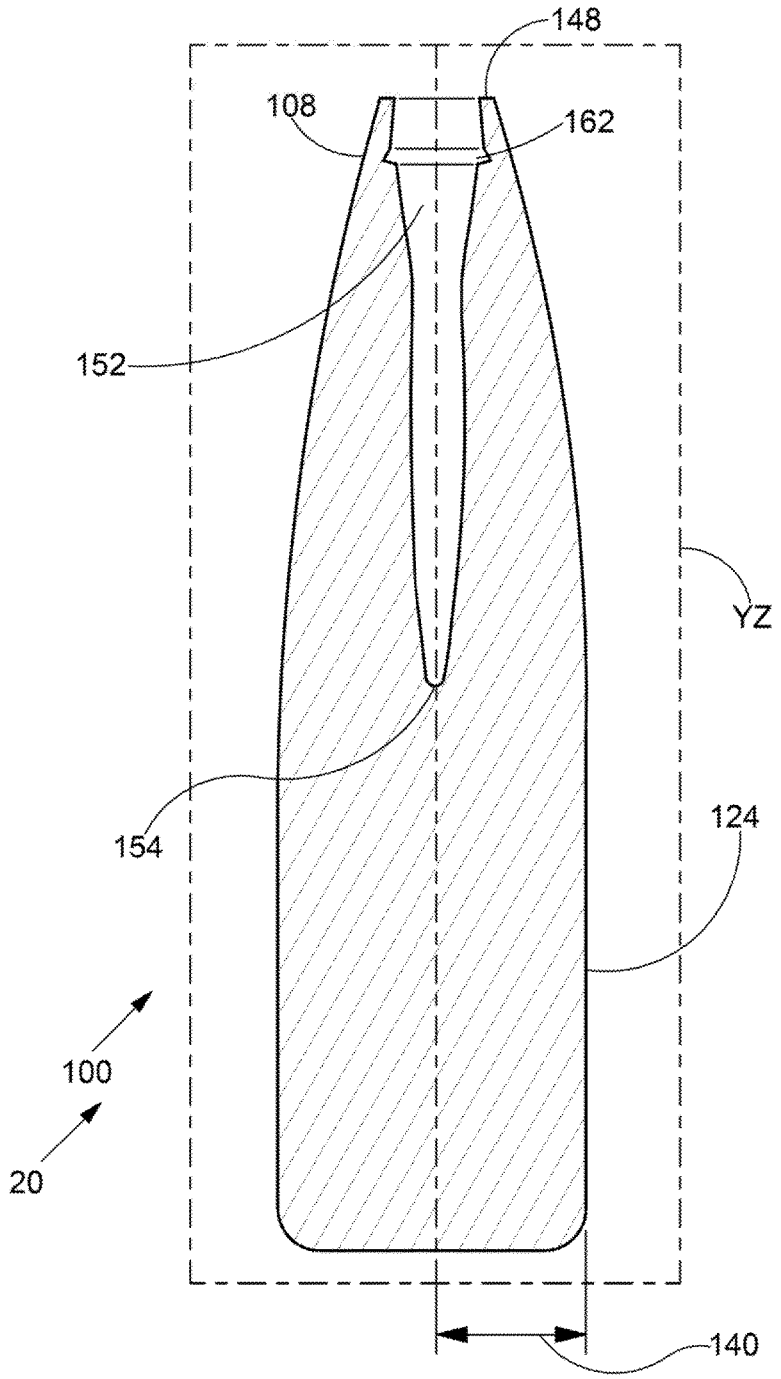
FIG. 4 is a cross-sectional view of a projectile in accordance with the detailed description. In the embodiment of FIG. 4, the projectile has been sectioned along a plane YZ.
Figure 5:
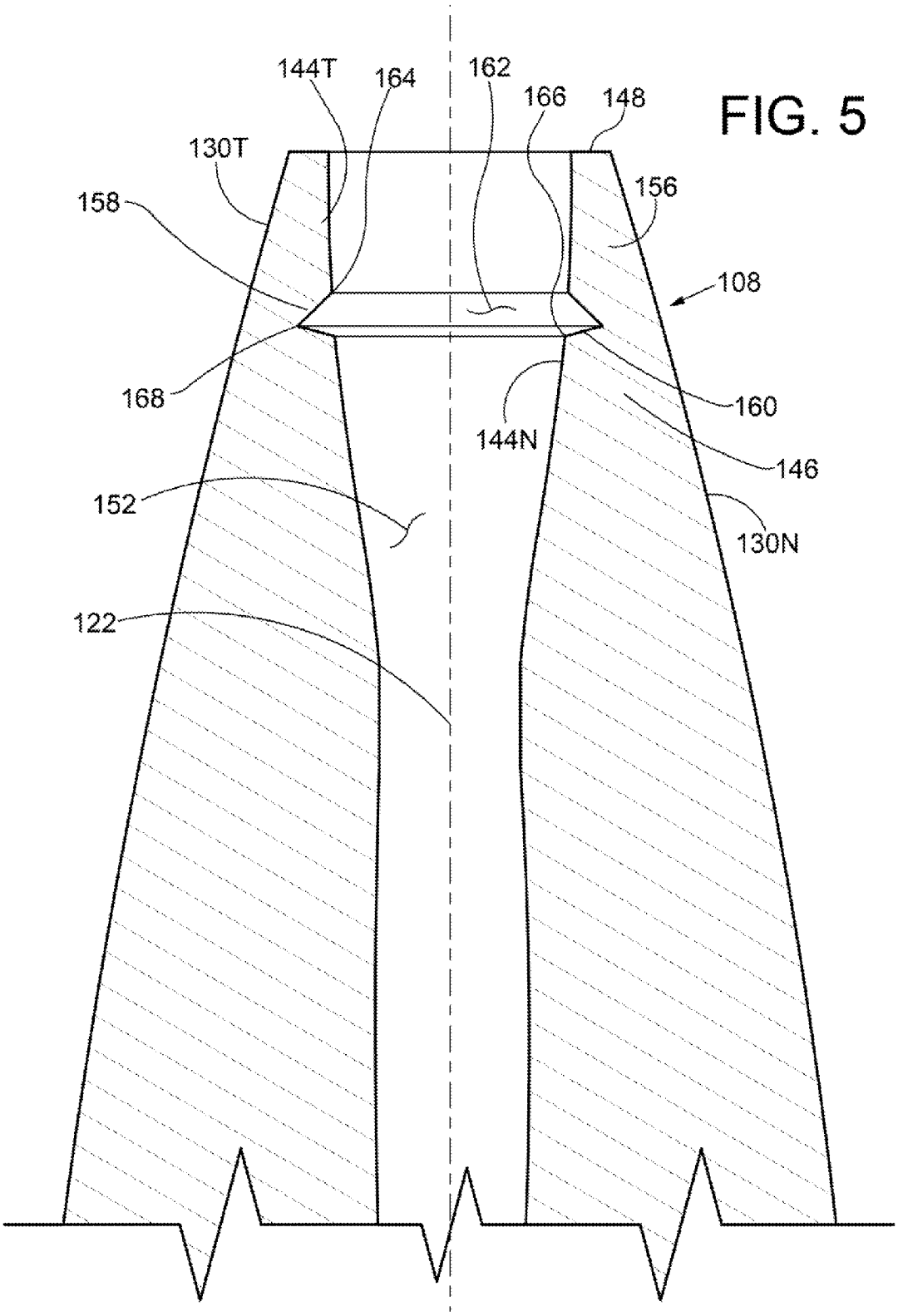
FIG. 5 is an enlarged cross-sectional view showing a portion of the projectile shown in FIGS. 1-4.
Figure 6:
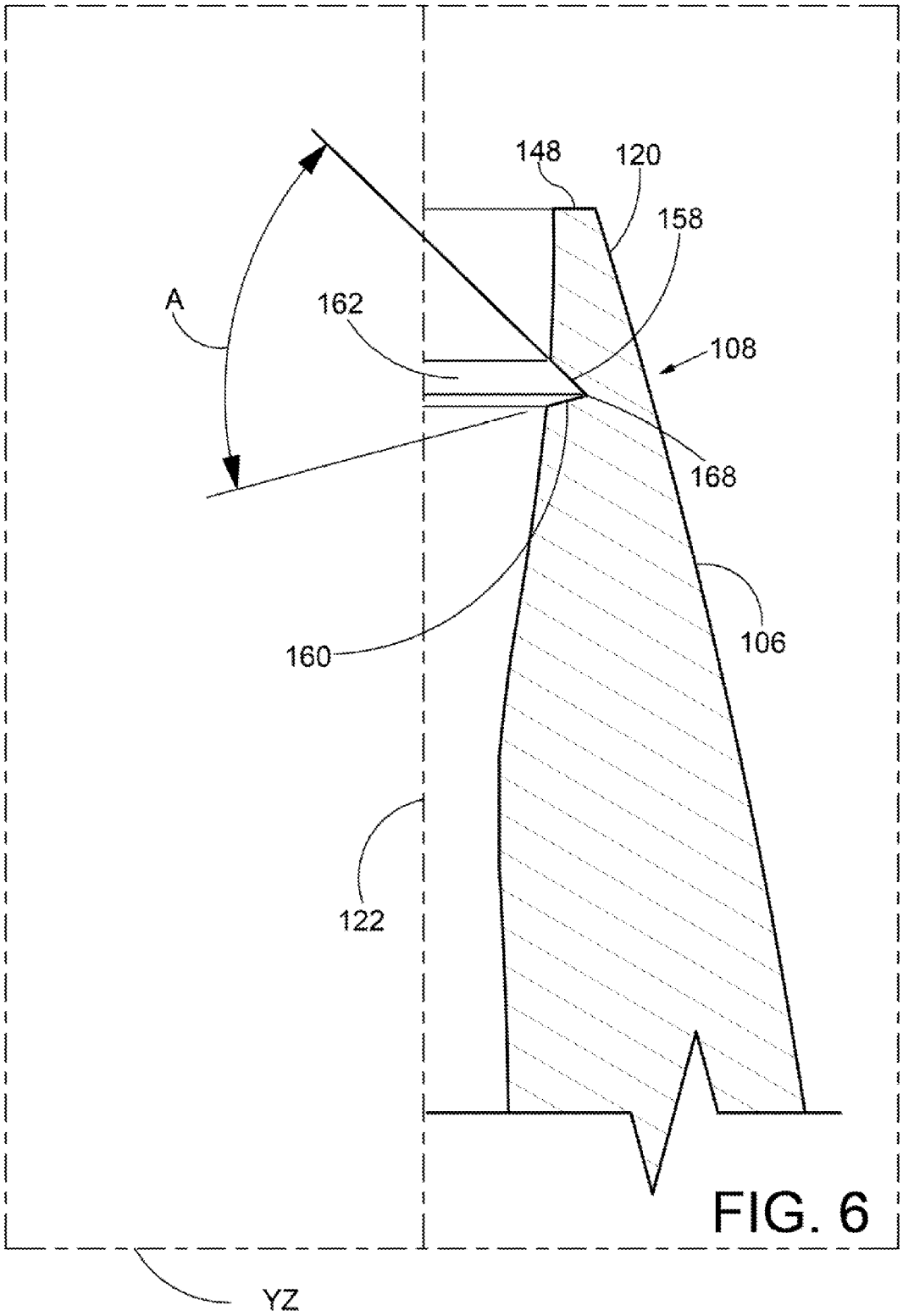
FIG. 6 is a partial cross-sectional view showing a portion of the projectile shown in FIG. 5.
Figure 7:
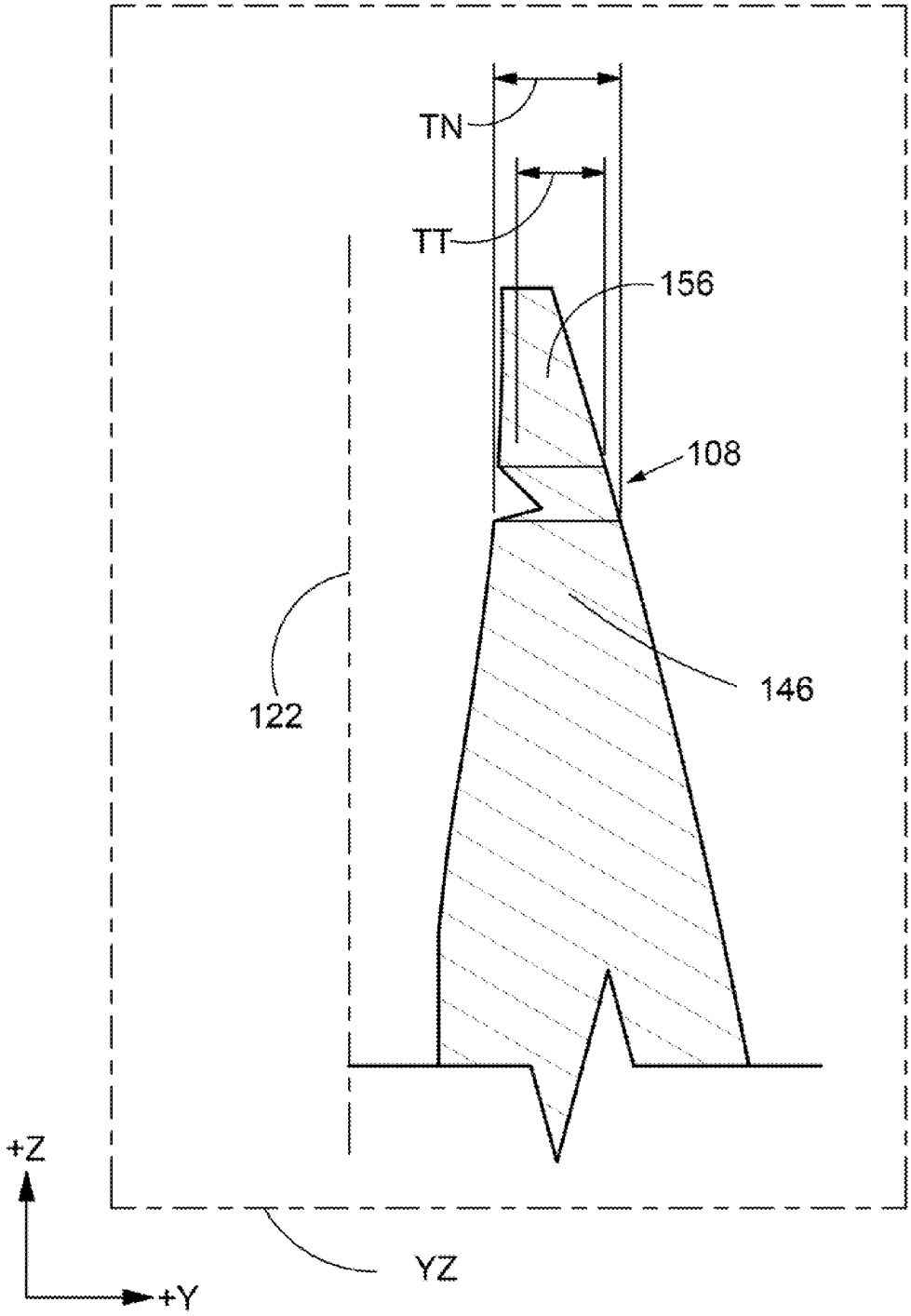
FIG. 7 is a partial cross-sectional view showing a portion of the projectile shown in FIG. 6.
Figure 8A:
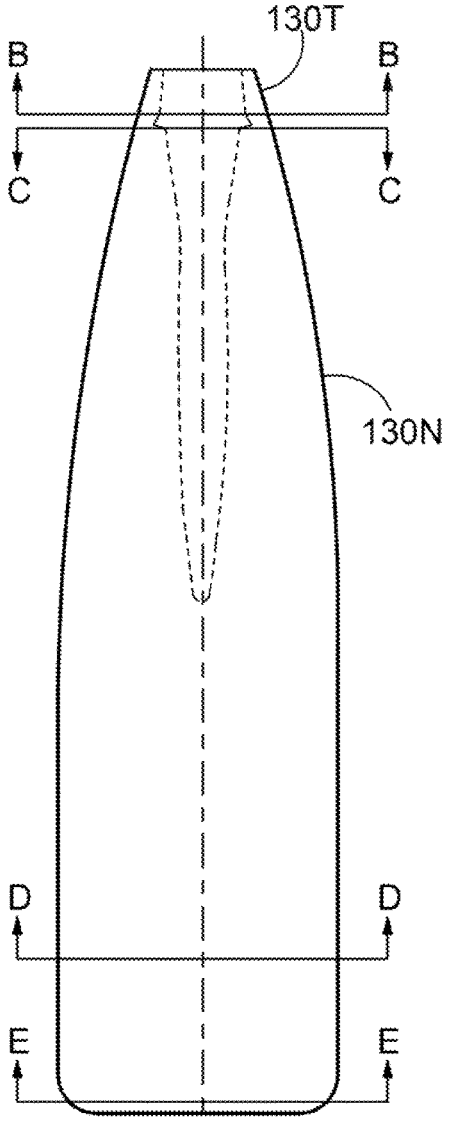
FIG. 8A is a side view of a projectile in accordance with the detailed description.
Figure 8B:
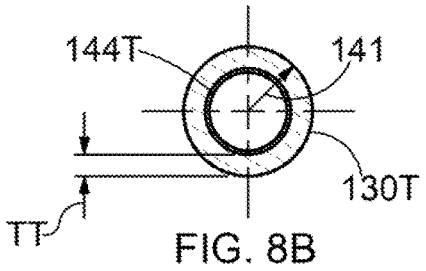
FIG. 8B is a cross-sectional view of the projectile shown in FIG. 8A taken along section line B-B shown in FIG. 8A.
Figure 8C:
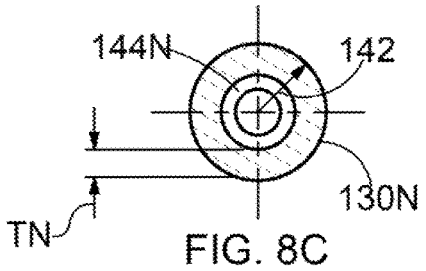
FIG. 8C is a cross-sectional view of the projectile shown in FIG. 8A taken along section line C-C shown in FIG. 8A.
Figure 8E:
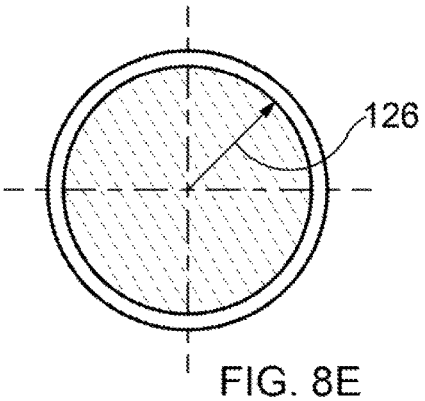
FIG. 8E is a cross-sectional view of the projectile shown in FIG. 8A taken along section line E-E shown in FIG. 8A.
Figure 8D:
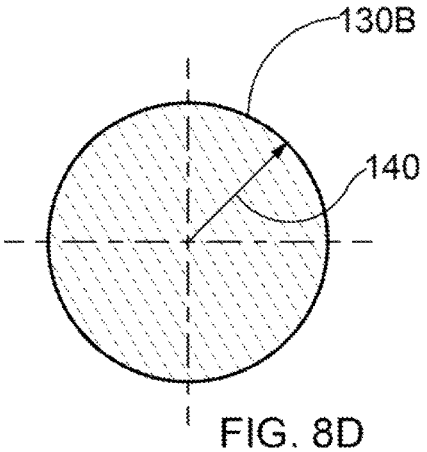
FIG. 8D is a cross-sectional view of the projectile shown in FIG. 8A taken along section line D-D shown in FIG. 8A.
Figure 9A:
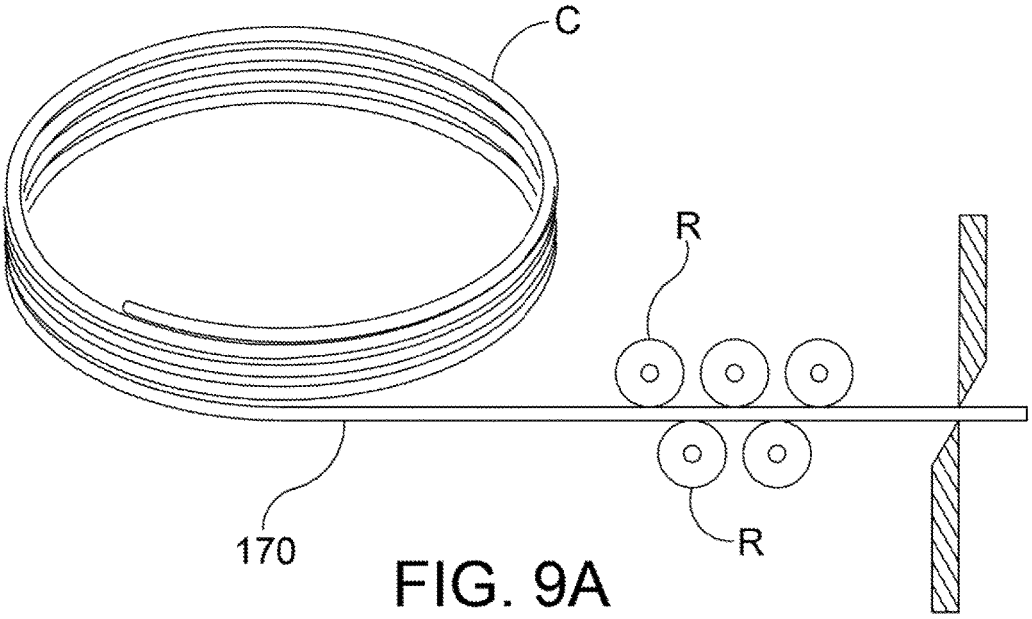
FIG. 9A is a diagram showing a coil of metal wire and a set of rollers for straightening the wire.
Figure 9B:
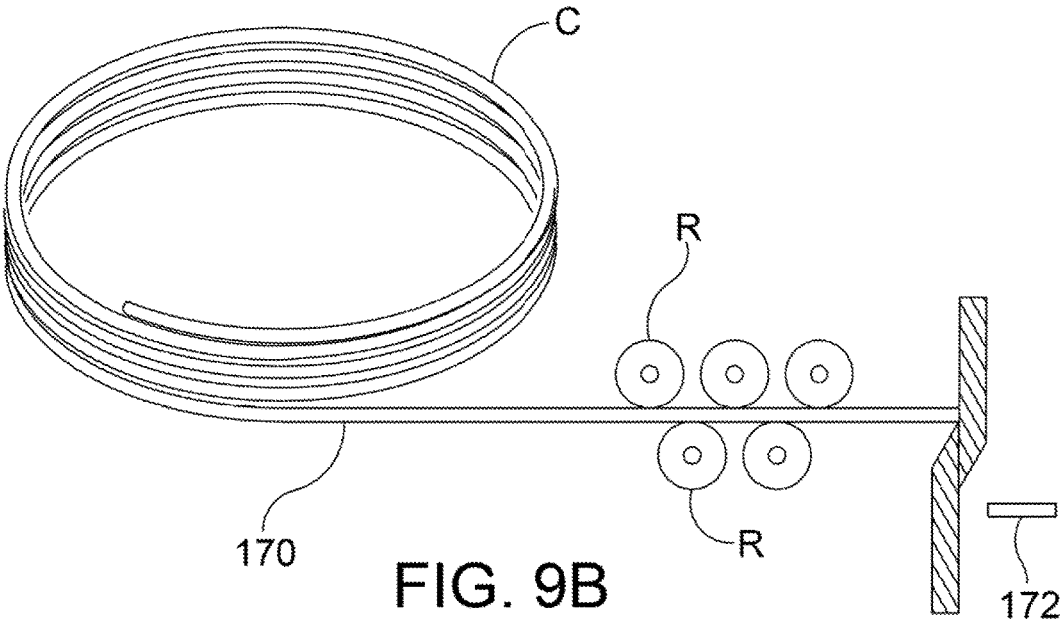
FIG. 9B is a diagram showing a length of straightened metal wire and a billet cut from the straightened metal wire.
Figure 10A:
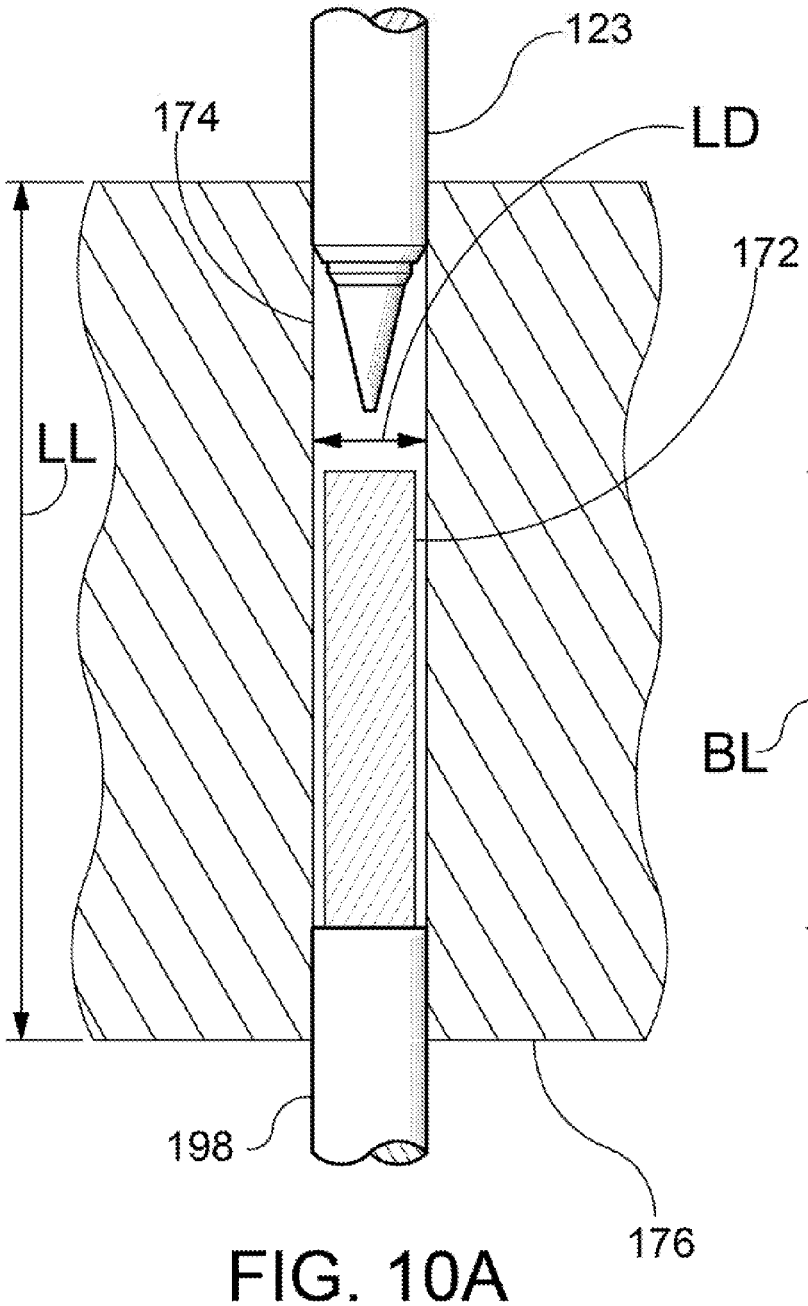
FIG. 10A is a partial cross-sectional view showing an assembly including a first die defining a lumen and a billet disposed in the lumen.
Figure 10B:
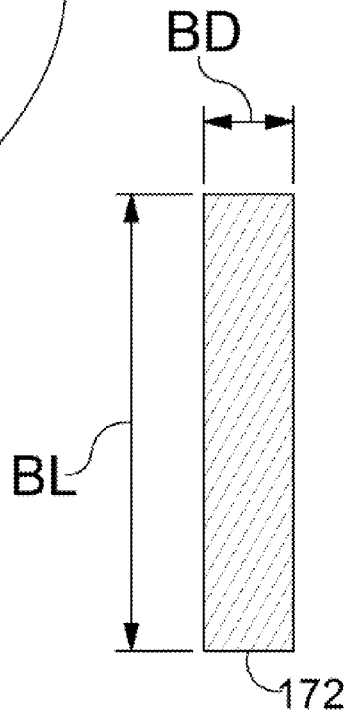
FIG. 10B is a cross-sectional view of a billet cut from a length of straightened metal wire.
Figure 11A:
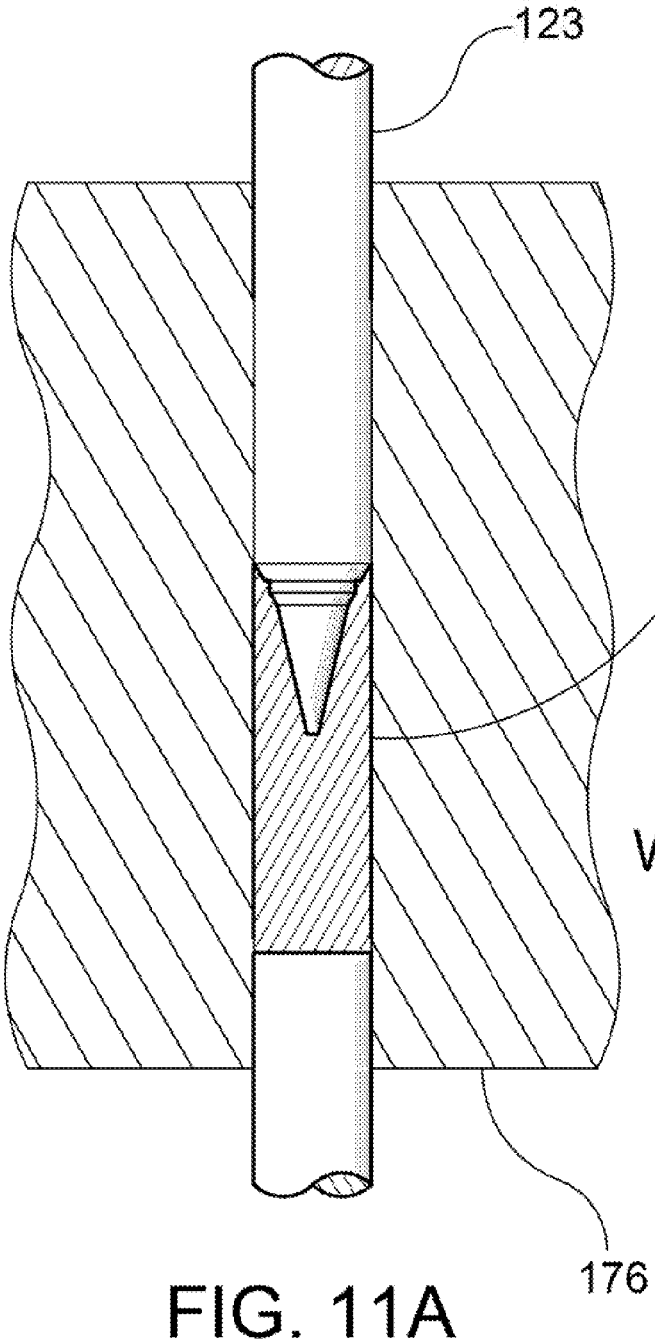
FIG. 11A is a partial cross-sectional view showing an assembly including a first die, a tool and a pin.
Figure 11B:
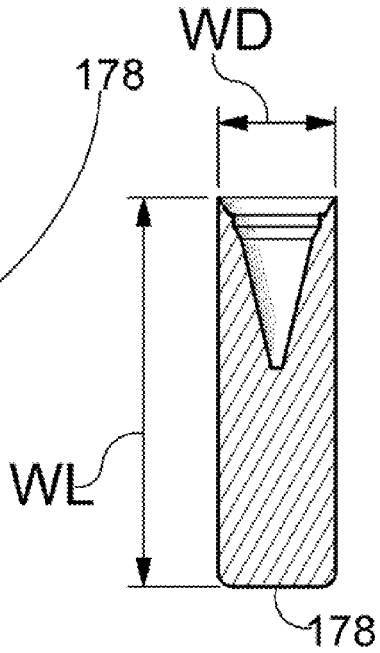
FIG. 11B is a cross-sectional view of a workpiece formed using a method in accordance with the detailed description.
Figure 12A:
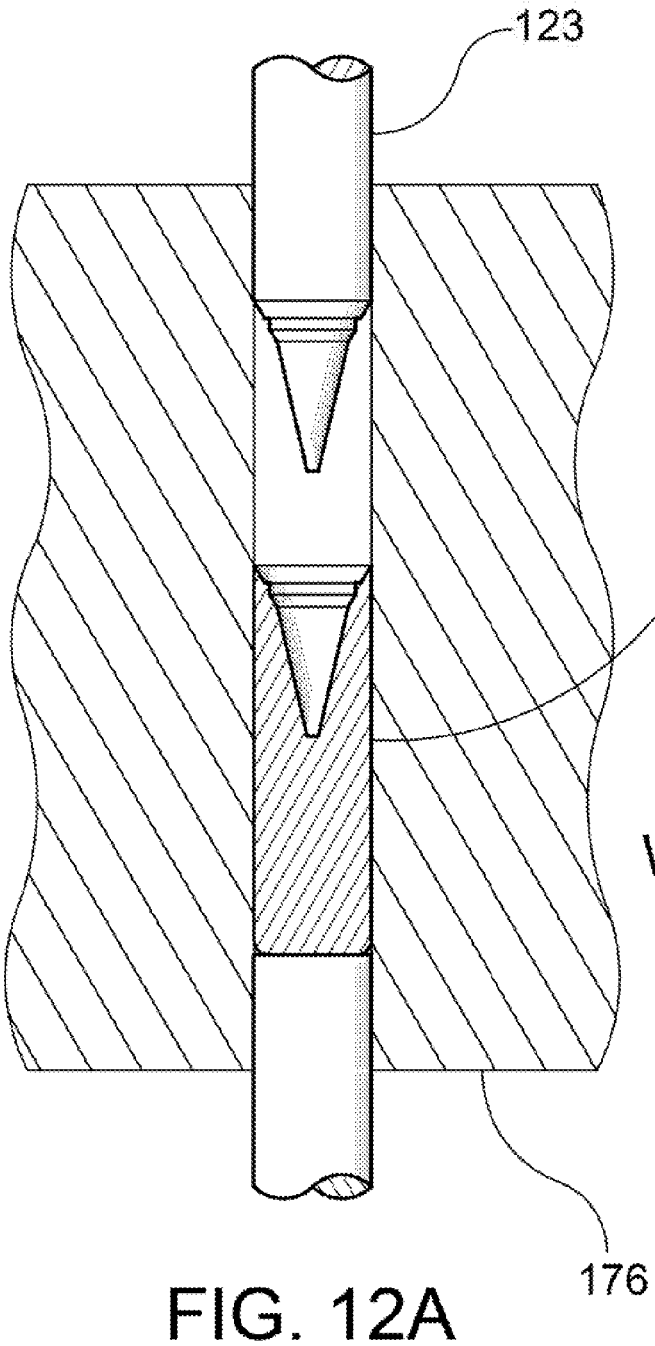
FIG. 12A is a partial cross-sectional view showing an assembly including a first die, a tool and a pin.
Figure 12B:
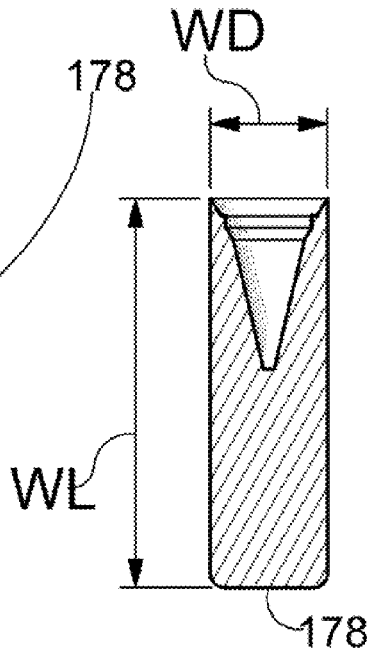
FIG. 12B is a cross-sectional view of a workpiece formed using a method in accordance with the detailed description.
Figure 13A:
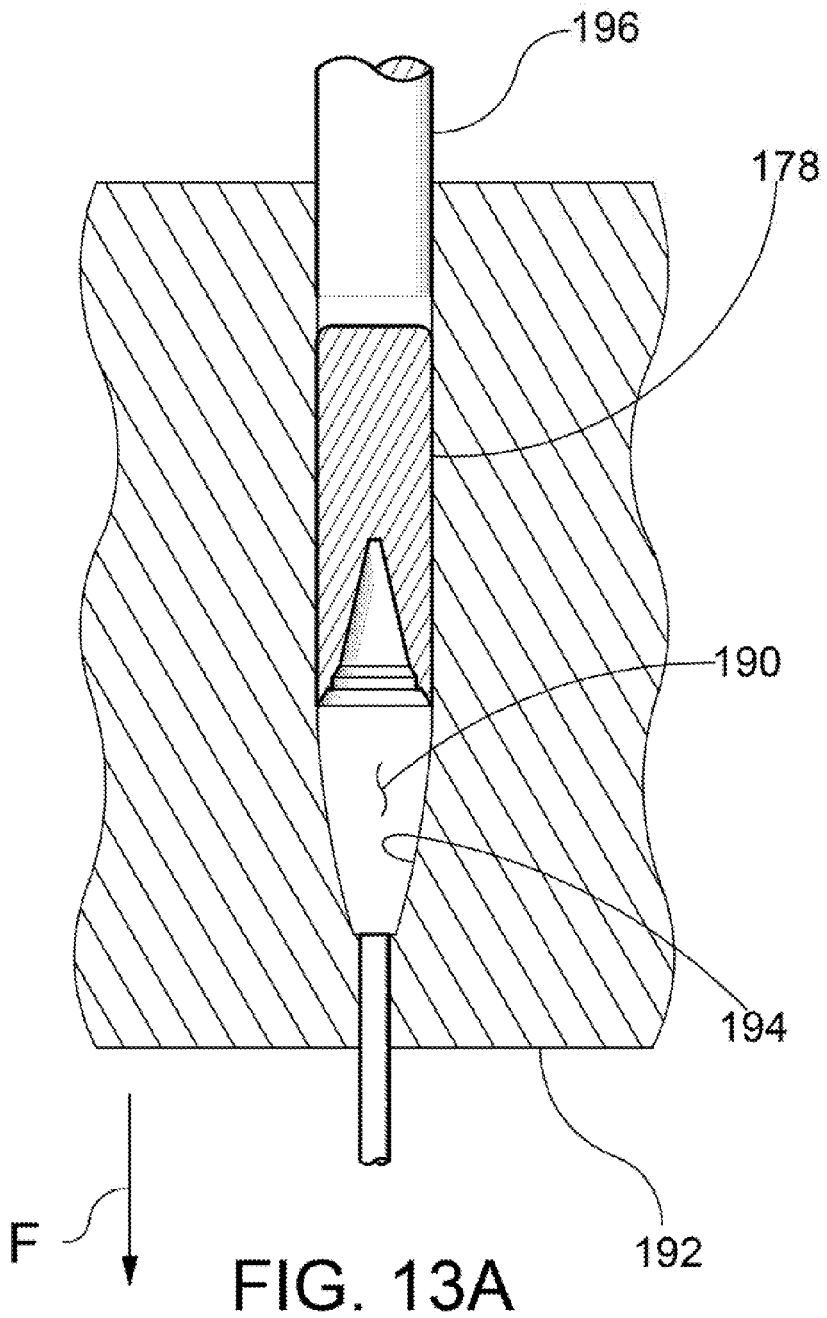
FIG. 13A is a partial cross-sectional view showing an assembly including a second die defining a die cavity and a workpiece disposed in the die cavity.
Figure 13B:
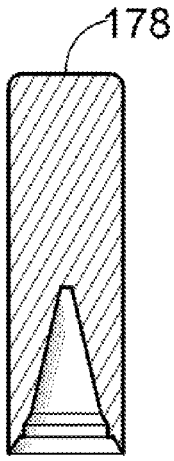
FIG. 13B is a cross-sectional view of a workpiece formed using a method in accordance with the detailed description.
Figure 14A:
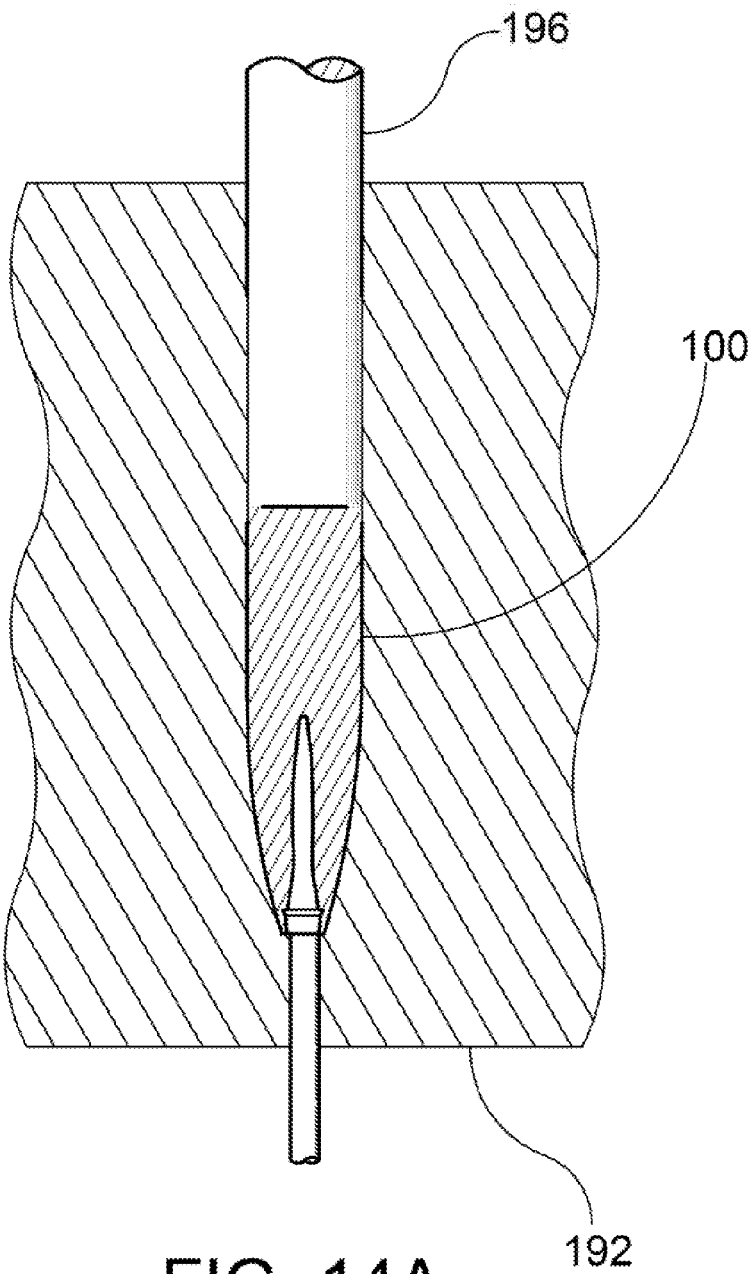
FIG. 14A is a partial cross-sectional view showing an assembly including a second die and a drive pin.
Figure 14B:
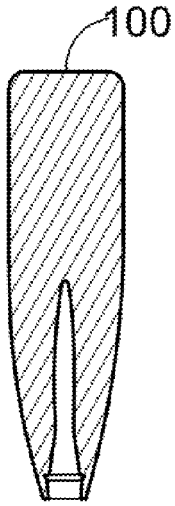
FIG. 14B is a cross-sectional view of a projectile body formed using a method in accordance with the detailed description.
Figure 15A:
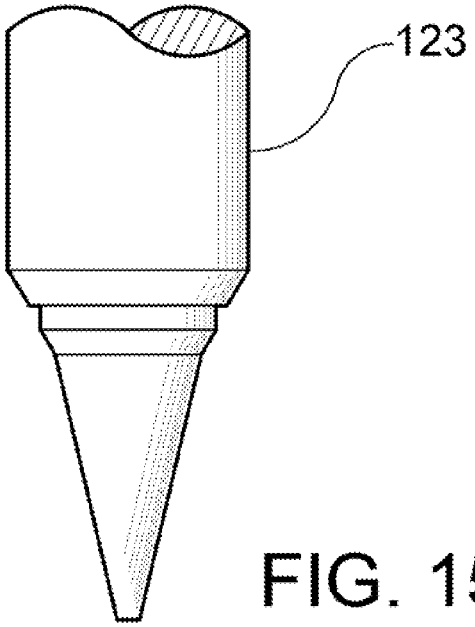
FIG. 15A is a side view of a tool in accordance with the detailed description.
Figure 15B:
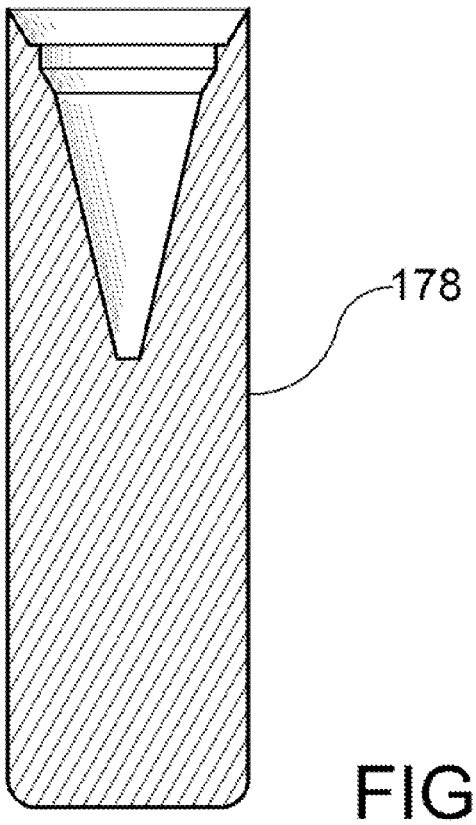
FIG. 15B is a cross-sectional view of a workpiece formed using a method in accordance with the detailed description.
Figure 16:
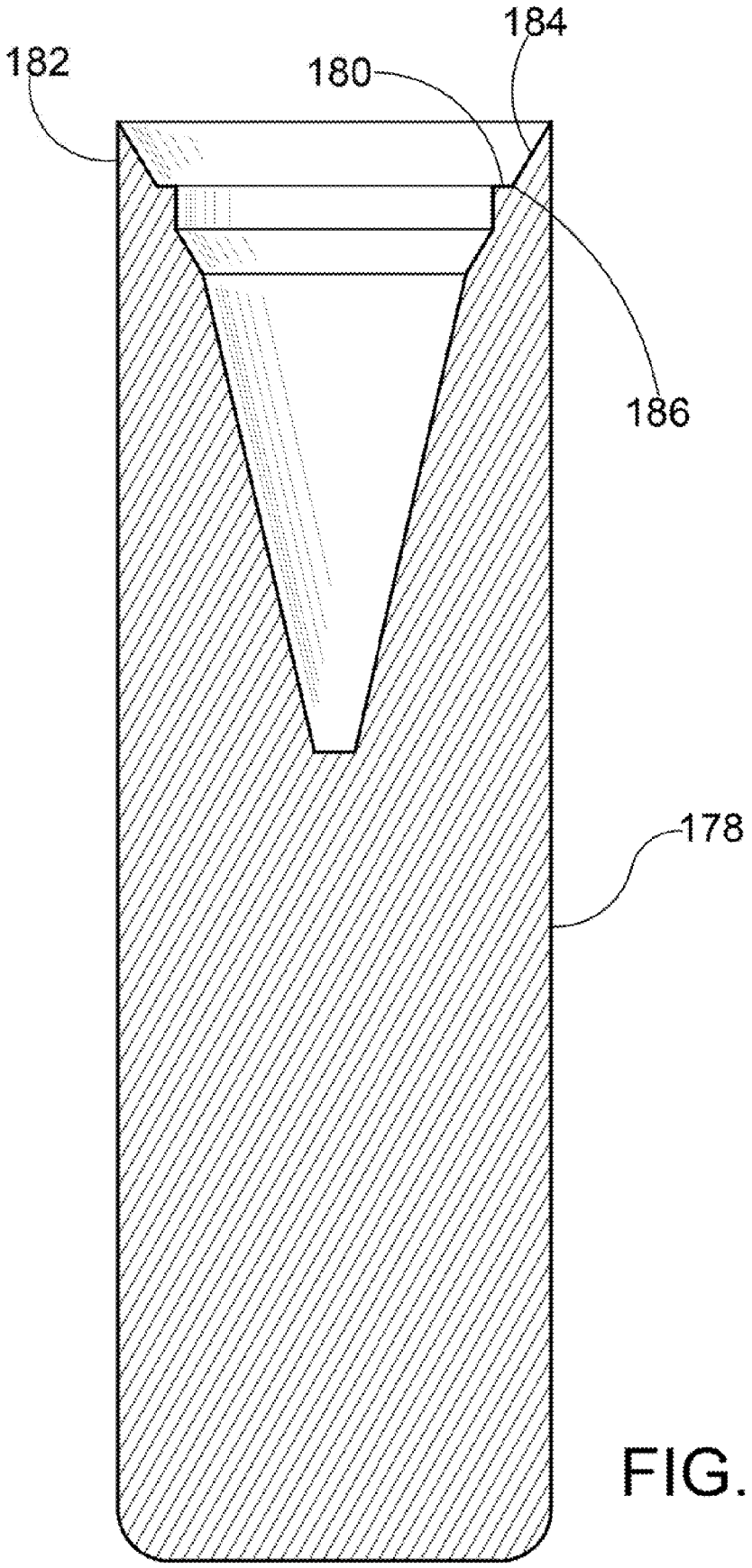
FIG. 16 is an enlarged cross-sectional view of a workpiece formed using a method in accordance with the detailed description.

Referring to FIGS. 1 and 3, a forward direction Z and a rearward direction −Z are illustrated using arrows labeled "Z" and "−Z," respectively. A starboard direction Y and a portward direction −Y are illustrated using arrows labeled "Y" and "−Y," respectively. An upward direction X and a downward direction −X are illustrated using arrows labeled "X" and "−X," respectively. The directions illustrated using these arrows are applicable to the apparatus shown and discussed throughout this application. The port direction may also be referred to as the portward direction. In one or more embodiments, the upward direction is generally opposite the downward direction. In one or more embodiments, the upward direction and the downward direction are both generally orthogonal to an ZY plane defined by the forward direction and the starboard direction. In one or more embodiments, the forward direction is generally opposite the rearward direction. In one or more embodiments, the forward direction and the rearward direction are both generally orthogonal to a XY plane defined by the upward direction and the starboard direction. In one or more embodiments, the starboard direction is generally opposite the port direction. In one or more embodiments, the starboard direction and the port direction are both generally orthogonal to a ZX plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

The following United States patents are hereby incorporated by reference herein: U.S. Pat. No. 3,881,421, U.S. Pat. No. 4,044,685, U.S. Pat. No. 4,655,140, U.S. Pat. No. 4,685,397, U.S. Pat. No. 5,127,332, U.S. Pat. No. 5,259,320, U.S. Pat. No. 535,101, U.S. Pat. No. 6,070,532, and U.S. Pat. No. 8,186,277.

The following United States patents are hereby incorporated by reference herein: U.S. Pat. No. 1,080,974, U.S. Pat. No. 1,135,357, U.S. Pat. No. 1,493,614, U.S. Pat. No. 1,328,334, U.S. Pat. No. 1,967,416, U.S. Pat. No. 375,158, U.S. Pat. No. 5,454,325, U.S. Pat. No. 6,317,946 and U.S. Pat. No. 7,380,502.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A projectile comprising:

a homogeneous projectile body including a tail portion, a barrel engaging portion, a nose portion, a grooved portion, and a tip portion disposed along a central longitudinal axis of the projectile body;

the tail portion having a rearward facing surface defining an XY plane, the tail portion extending forwardly along the central longitudinal axis of the projectile body between the rearward facing surface and the barrel engaging portion, the central longitudinal axis being orthogonal to the XY plane, the tail portion having a tail radius extending between the central longitudinal axis and an outer surface of the tail portion, the tail radius increasing as the tail portion extends forwardly along the central longitudinal axis;

the barrel engaging portion of the projectile body extending forwardly along the central longitudinal axis between the tail portion and the nose portion, the barrel engaging portion having a barrel engaging radius extending between the central longitudinal axis and an outer surface of the barrel engaging portion, the barrel engaging radius remaining substantially constant as the barrel engaging portion extends forwardly along the central longitudinal axis so that the barrel engaging portion has a shape generally corresponding to the shape of a cylinder;

the nose portion of the projectile body extending forwardly along the central longitudinal axis between the barrel engaging portion and the grooved portion, the nose portion having a nose radius extending between the central longitudinal axis and an outer surface of the nose portion, the nose radius decreasing as the nose portion extends forwardly along the central longitudinal axis so that the nose portion has a shape generally corresponding to the shape of an ogive, the nose portion having an interior surface and a nose wall extending between the interior and exterior surfaces thereof;

the grooved portion of the projectile body extending forwardly along the central longitudinal axis between the nose portion and the tip portion;

the tip portion of the projectile body extending forwardly along the central longitudinal axis between the grooved portion and a forward facing edge of the tip portion, the forward facing edge defining an opening in the tip portion, the opening fluidly communicating with an interior cavity extending from the opening to a cavity end point within the nose portion, a forward portion of the interior cavity being defined by an interior surface of the tip portion, the tip portion having an exterior surface that is convex when viewed in a longitudinal cross-section of the projectile body, the tip portion having a tip wall extending between the interior and exterior surfaces thereof;

the grooved portion of the projectile body having first and second groove defining surfaces, the first and second groove-defining surfaces displaced from the forward facing edge of the tip portion and defining an internal annular groove, the first groove defining surface meeting the interior surface of the tip portion at a forward edge of the annular groove, the second groove defining surface meeting an interior surface of the nose portion at a rearward edge of the annular groove, the first and second groove defining surfaces intersecting and defining an apex of the annular groove, the first and second groove defining surfaces defining an included angle of the annular groove, the included angle having a magnitude of less than 90 degrees;

the nose wall having a minimum thickness at the rearward edge of the annular groove, the tip wall having a maximum thickness at the forward edge of the annular groove, the minimum thickness of the nose wall being greater than the maximum thickness of the tip wall.

2. The projectile of claim 1 wherein the included angle is between 60 degrees and 90 degrees.

3. The projectile of claim 1 wherein the projectile body is formed of copper.

4. The projectile of claim 3 wherein the projectile has a barrel engaging radius of between 0.07 inches and 0.25 inches.

5. The projectile of claim 1 wherein the interior surface of the tip portion is concave when viewed in a longitudinal cross-section of the projectile body.

6. The projectile of claim 1 wherein the interior surface of the tip portion is convex when viewed in a longitudinal cross-section of the projectile body.

7. The projectile of claim 1 wherein the thickness of the tip wall at the forward edge of the annular groove is between 0.010 inches and 0.038 inches.

8. The projectile of claim 7 wherein the thickness of the tip wall at the forward edge of the annular groove is between 0.012 inches and 0.028 inches.

9. The projectile of claim 1 wherein the thickness of the nose wall at the rearward edge of the annular groove is between 0.015 inches and 0.050 inches.

10. The projectile of claim 9 wherein the thickness of the nose wall at the rearward edge of the annular groove is between 0.016 inches and 0.036 inches.

11. The projectile of claim 1 wherein the annular groove is generally V-shaped when viewed in a longitudinal cross-section of the projectile.

12. The projectile of claim 1 wherein the interior cavity extends rearward from the opening along the central longitudinal axis by a distance more than 35% of an overall length of the projectile body.

13. The projectile of claim 12 wherein the interior cavity extends rearward from the opening along the central longitudinal axis by a distance more than 45% of an overall length of the projectile body.

14. The projectile of claim 1 wherein the annular groove has a depth extending laterally outward from the rearward edge of the annular groove that is greater than 33% of the minimum thickness of the nose wall.

15. The projectile of claim 1 wherein the annular groove has a depth extending laterally outward from the forward edge of the annular groove that is greater than 33% of the maximum thickness of the tip wall.

16. A centerfire rifle cartridge comprising a casing with a primer, propellant in the casing, and a hollow point bullet in the casing, the hollow point bullet being homogeneous and comprising copper, the bullet having a forward end with a lip defining a mouth and an interior sidewall defining a cavity extending rearwardly from the lip, the interior sidewall having a forward sidewall portion extending from the forward lip and converging to a neck portion of the sidewall and defining a first funnel portion, the interior sidewall at a mid-sidewall portion contiguous with and rearward of the neck portion, the mid-sidewall portion diverging to an increased diameter portion, the interior sidewall converging from the increased diameter portion to a rearward-most terminus of the cavity, the forward sidewall portion at the first funnel portion having an internal circumferential notch intermediate the mouth of the cavity and the neck portion, the internal circumferential notch defined by a two groove surfaces, the groove surfaces spaced rearwardly from the mouth.

17. The projectile of claim 16 wherein the annular groove is generally V-shaped when viewed in a longitudinal cross-section of the projectile.

18. The projectile of claim 16 wherein the interior cavity extends rearward from the opening along the central longitudinal axis by a distance more than 35% of an overall length of the projectile body.

19. The projectile of claim 16 wherein the projectile has a barrel engaging radius of between 0.07 inches and 0.25 inches.

20. The projectile of claim 16 wherein the annular groove is generally V-shaped when viewed in a longitudinal cross-section of the projectile, the interior cavity extends rearward from the opening along the central longitudinal axis by a distance more than 35% of an overall length of the projectile body, and the projectile has a barrel engaging radius of between 0.07 inches and 0.25 inches.

* * * * *